US011852449B2

(12) United States Patent
Nichols et al.

(10) Patent No.: US 11,852,449 B2
(45) Date of Patent: Dec. 26, 2023

(54) BISMUTH-BASED FIREARM PROJECTILES, FIREARM CARTRIDGES INCLUDING THE SAME, AND RELATED METHODS

(71) Applicant: Federal Cartridge Company, Anoka, MN (US)

(72) Inventors: Robert Charles Nichols, Albany, OR (US); Zachary Hugh Smith, Lebanon, OR (US); Ralph Nauman, Bend, OR (US)

(73) Assignee: Federal Cartridge Company, Anoka, MN (US)

( * ) Notice: Subject to any disclaimer, the term of this patent is extended or adjusted under 35 U.S.C. 154(b) by 0 days.

(21) Appl. No.: 17/358,465

(22) Filed: Jun. 25, 2021

(65) Prior Publication Data

US 2022/0120543 A1 Apr. 21, 2022

Related U.S. Application Data

(60) Provisional application No. 63/044,209, filed on Jun. 25, 2020.

(51) Int. Cl.

| | |
|---|---|
| ***F42B 12/74*** | (2006.01) |
| ***C22C 12/00*** | (2006.01) |
| ***F42B 12/78*** | (2006.01) |

(52) U.S. Cl.

CPC ..... *F42B 12/74* (2013.01); *C22C 12/00* (2013.01); *F42B 12/78* (2013.01)

(58) Field of Classification Search

CPC ..... F42B 12/74; F42B 12/78; C22C 12/00
See application file for complete search history.

(56) References Cited

U.S. PATENT DOCUMENTS

| | | | | |
|---|---|---|---|---|
| 5,535,678 | A | 7/1996 | Brown | |
| 6,074,454 | A | 6/2000 | Abrams et al. | |
| 7,966,937 | B1 * | 6/2011 | Jackson | F42B 12/74 102/501 |
| 9,157,713 | B1 * | 10/2015 | Peterson | F42B 10/48 |
| 10,641,591 | B1 * | 5/2020 | Rubin | F42B 12/46 |
| 2005/0082337 | A1 | 4/2005 | Riedl | |
| 2006/0283314 | A1 | 12/2006 | Cesaroni | |
| 2007/0074637 | A1 * | 4/2007 | Pontieri | F42B 10/24 102/524 |

(Continued)

FOREIGN PATENT DOCUMENTS

| | | | |
|---|---|---|---|
| WO | 2002068897 A1 | 9/2002 | |
| WO | WO-2014145719 A2 * | 9/2014 | F42B 7/04 |

(Continued)

OTHER PUBLICATIONS

International Search Report and Written Opinion for PCT/US2021/039073, dated Oct. 27, 2021.

*Primary Examiner* — Jonathan C Weber
(74) *Attorney, Agent, or Firm* — Reed Smith LLP; Matthew P. Frederick; Travis J. Sumpter

(57) ABSTRACT

Bismuth-based firearm projectiles, optionally firearm cartridges containing the same, and methods for forming bismuth-tin-copper alloys or bismuth-nickel alloys and bismuth-based firearm projectiles are disclosed herein. The bismuth-based firearm projectiles include a projectile body comprising a bismuth-tin-copper alloy or bismuth-nickel alloy that forms at least 90 wt % of the projectile body.

20 Claims, 7 Drawing Sheets

(56) References Cited

U.S. PATENT DOCUMENTS

| | | | | |
|---|---|---|---|---|
| 2012/0204708 | A1* | 8/2012 | Pearson | F42B 33/00 29/592 |
| 2013/0145951 | A1* | 6/2013 | Nauman | F42B 7/04 102/448 |
| 2014/0290521 | A1* | 10/2014 | Meyer | F42B 7/08 102/450 |
| 2016/0131464 | A1* | 5/2016 | Rubin | F42B 12/54 102/501 |
| 2016/0298947 | A1* | 10/2016 | Rubin | F42B 12/54 |
| 2019/0154421 | A1* | 5/2019 | Amick | F42B 10/38 |
| 2021/0140747 | A1* | 5/2021 | McDevitt | F42B 33/0207 |

FOREIGN PATENT DOCUMENTS

| | | | | |
|---|---|---|---|---|
| WO | WO-2016060726 | A1 * | 4/2016 | F42B 12/34 |
| WO | WO-2016130190 | A2 * | 8/2016 | F42B 12/34 |

* cited by examiner

BISMUTH-BASED FIREARM PROJECTILES, FIREARM CARTRIDGES INCLUDING THE SAME, AND RELATED METHODS

CROSS-REFERENCE TO RELATED APPLICATION

This application claims the benefit under 35 U.S.C. § 119(e) of the earlier filing date of U.S. Provisional Patent Application No. 63/044,209 filed on Jun. 25, 2020, the disclosure of which is incorporated by reference herein.

FIELD

The present disclosure relates to bismuth-based firearm projectiles.

BACKGROUND

Historically, lead has been the metal of choice for forming firearm projectiles. Firearm projectiles formed from lead tend to possess ballistic efficiencies that are difficult to match using other metals due to the high density of lead (11.3 g/cc). Additionally, lead is a soft and malleable metal that is easy to form into a variety of projectile shapes. However, under certain conditions, environmental and/or wildlife regulations may preclude the use of lead as a projectile due to the environmental toxicity of lead. Thus, alternative projectile materials have been pursued.

SUMMARY

In embodiments, the present disclosure is directed to a bismuth-based firearm projectile, comprising: a projectile body comprising a bismuth-nickel alloy that forms at least 90 weight percent (wt %) of the projectile body; wherein the bismuth-nickel alloy comprises an alloy of bismuth and nickel; and wherein the bismuth-nickel alloy comprises 90-99.5 wt % bismuth and 0.5-10 wt % nickel.

In embodiments, the present disclosure is directed to a bismuth-based firearm projectile, comprising: a projectile body comprising a bismuth-nickel alloy that forms at least 90 weight percent (wt %) of the projectile body; wherein the bismuth-nickel alloy comprises an alloy of bismuth and nickel; and wherein the bismuth-nickel alloy comprises 90-99.9 wt % bismuth and 0.1-10 wt % nickel.

In embodiments, the bismuth-nickel alloy comprises at least one of at least 0.12 wt % nickel, at least 0.14 wt % nickel, at least 0.16 wt % nickel, at least 0.18 wt % nickel, at least 0.2 wt % nickel, at least 0.25 wt % nickel, at least 0.3 wt % nickel, at least 0.5 wt % nickel, at least 0.75 wt % nickel, at most 0.2 wt % nickel, at most 0.25 wt % nickel, at most 0.3 wt % nickel, at most 0.5 wt % nickel, at most 0.75 wt % nickel, at most 1 wt % nickel, at most 1.5 wt % nickel, at most 2 wt % nickel, at most 3 wt % nickel, and at most 5 wt % nickel.

In embodiments, the bismuth-nickel alloy comprises 99-99.5 wt % bismuth and 0.5-1 wt % nickel.

In embodiments, the bismuth-nickel alloy comprises 99-99.9 wt % bismuth and 0.1-1 wt % nickel.

In embodiments, the bismuth-nickel alloy comprises 99.2-99.5 wt % bismuth and 0.5-0.8 wt % nickel In embodiments, the bismuth-nickel alloy comprises 99.2-99.9 wt % bismuth and 0.1-0.8 wt % nickel In embodiments, the bismuth-nickel alloy forms at least one of at least 92 wt %, at least 94 wt %, at least 96 wt %, at least 98 wt %, at least 99 wt %, and at most 100 wt % of the projectile body.

In embodiments, the firearm projectile further comprises a coating applied to an exterior of the projectile body.

In embodiments, the coating is a copper jacket.

In embodiments, the coating includes one or more of copper, a copper alloy, nickel, a nickel alloy, iron, an iron alloy, zinc, aluminum, tungsten, and gilding metal.

In embodiments, the projectile body comprises a stiffness that is at most 50% of a stiffness of a bismuth-tin projectile body of an equivalent size and shape, wherein the bismuth-tin projectile body consists of a 95Bi5Sn alloy bismuth-tin alloy.

In embodiments, the stiffness of the projectile body is a threshold fraction of the stiffness of the bismuth-tin projectile body, and wherein the threshold fraction is at least one of at least 40%, at least 50%, at least 60%, at least 70%, at most 70%, at most 80%, and at most 90%.

In embodiments, the projectile body comprises a density of at least one of at least 9.4 grams per cubic centimeter (g/cc), at least 9.5 g/cc, at least 9.55 g/cc, at least 9.6 g/cc, at least 9.65 g/cc, at least 9.7 g/cc, at least 9.71 g/cc, at least 9.72 g/cc, at least 9.73 g/cc, at least 9.74 g/cc, at least 9.75 g/cc, at most 9.72 g/cc, at most 9.73 g/cc, at most 9.74 g/cc, at most 9.75 g/cc, at most 9.76 g/cc, and at most 9.78 g/cc.

In embodiments, the nickel is at least substantially dissolved in the bismuth.

In embodiments, the bismuth-nickel alloy comprises one or more Bi—Ni alloy domains.

In embodiments, the bismuth-nickel alloy is one or more of an annealed alloy, a stress-relieved alloy, and a heat-treated alloy.

In embodiments, the bismuth-based firearm projectile is a frangible firearm projectile, wherein the frangible firearm projectile has a weight and is configured to break entirely into small particulate when fired at a metal surface at close range from a firearm cartridge, and wherein the small particulate has a maximum particle weight of 5% of the weight of the frangible firearm projectile.

In certain embodiments, the disclosure is directed to a firearm cartridge, comprising: a casing that defines an internal volume; a propellant disposed in the internal volume; a primer disposed in the internal volume and configured to ignite the propellant; the bismuth-based firearm projectile of claim 1 at least partially received in the casing.

In other embodiments, a bismuth-based firearm projectile is disclosed, comprising: a projectile body comprising a bismuth alloy comprising an alloy of at least three metals, that forms at least 90 weight percent (wt %) of the projectile body; wherein the bismuth alloy comprises an alloy of bismuth, tin, and a third metal; and wherein the bismuth alloy comprises at least 85 wt % bismuth and at least 0.05 wt % the third metal.

In embodiments, the bismuth alloy comprises 90-99 wt % bismuth, 0.7-9.5 wt % tin, and 0.05-3 wt % copper.

In embodiments, the third metal comprises copper.

In embodiments, the bismuth alloy further comprises a fourth metal, wherein the fourth metal is one of antimony and zinc, and combinations thereof.

DETAILED DESCRIPTION

Figure 1:
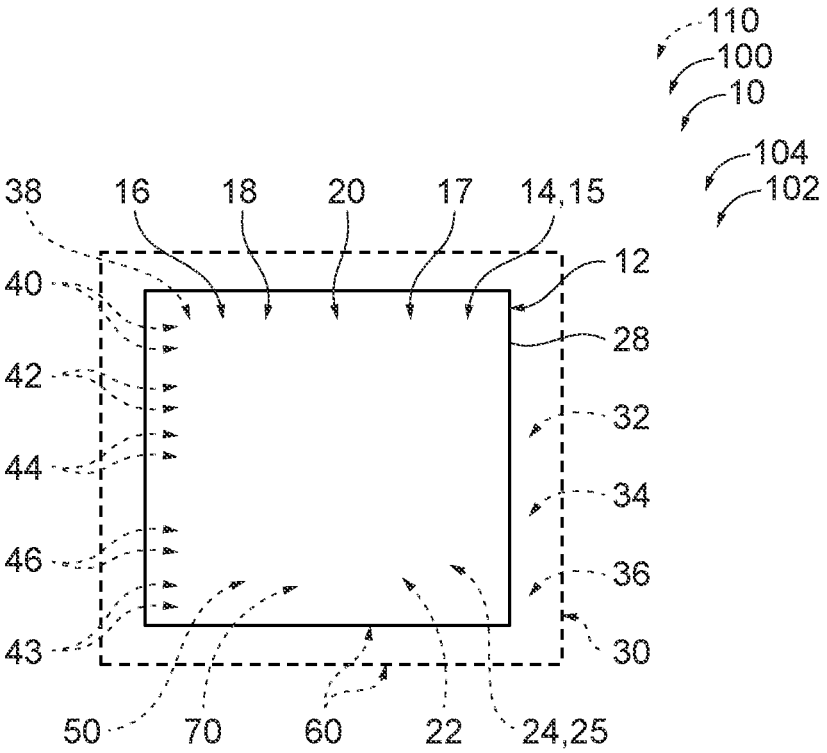
FIG. 1 is a schematic representation of embodiments of bismuth-based firearm projectiles according to the present disclosure.

Bismuth is an attractive replacement for lead in firearm projectiles owing to the relatively high density (9.78 g/cc) and low environmental toxicity of bismuth. The disclosure provides for bismuth-based firearm projectiles formed from bismuth-based alloys that have improved density and/or workability, and/or methods for forming bismuth-based alloys for firearm projectiles that have improved workability and/or density.

Bismuth-based firearm projectiles, optionally firearm cartridges containing the same, and methods for forming bismuth-tin-copper alloys, bismuth-nickel alloys, and bismuth-based firearm projectiles are disclosed herein. The bismuth-based firearm projectiles include a projectile body comprising a bismuth-tin-copper alloy or bismuth-nickel alloy that forms at least 90 weight percent of the projectile body. The bismuth-tin-copper alloy comprises an alloy of bismuth, tin, and copper, in which the bismuth-tin-copper alloy comprises at least 85 weight percent bismuth. The bismuth-tin-copper alloy may be a heat-treated alloy and may be less stiff, denser, and/or more malleable than conventional bismuth-tin alloys. The bismuth-nickel alloy comprises an alloy of bismuth and nickel, in which the bismuth-nickel alloy comprises at least 90 weight percent bismuth, and in other embodiments, at least 95 weight percent bismuth.

The methods may include forming a tin-copper master alloy, which includes forming a mixture of tin and copper and heating the mixture of tin and copper to a master alloy set point temperature. The methods further include forming a bismuth-tin-copper alloy or a bismuth-nickel alloy, which includes forming a mixture y and heating the mixture to a bismuth alloy set point temperature. The methods may include heat treating, forming into a projectile shape, and/or assembling a firearm cartridge that includes at least one bismuth-based firearm projectile.

FIGS. 1-10 provide embodiments of bismuth-based firearm projectiles 10, firearm cartridges 110 including bismuth-based firearm projectiles, and methods 500 for forming bismuth-based firearm projectiles and firearm cartridges including bismuth-based firearm projectiles. Elements that serve a similar, or at least substantially similar, purpose are labelled with like numbers in each of FIGS. 1-10, and these elements may not be discussed in detail herein with reference to each of FIGS. 1-10, but reference numbers associated therewith may be utilized herein for consistency. Elements, components, and/or features that are discussed herein with reference to one or more of FIGS. 1-10 may be included in and/or utilized with any of FIGS. 1-10 without departing from the scope of the present disclosure.

In general, elements that are likely to be included in a given (i.e., a particular) embodiment are illustrated in solid lines, while elements that are optional to a given embodiment are illustrated in dashed lines. However, elements that are shown in solid lines are not essential to all embodiments, and an element shown in solid lines may be omitted from a given embodiment without departing from the scope of the present disclosure.

FIG. 1 schematically illustrates embodiments of bismuth-based firearm projectiles 10 according to embodiments of the present disclosure. Bismuth-based firearm projectiles 10 include a projectile body 12 that may comprise a bismuth-tin-copper alloy 14 or, alternatively, a bismuth-nickel alloy 15. Bismuth-based firearm projectiles 10 additionally or alternatively may be referred to herein as bismuth-tin-copper alloy firearm projectiles 10, bismuth-nickel alloy 15, bismuth alloy firearm projectiles 10, and/or firearm projectiles 10. Projectile body 12 may form the bulk, core, and/or center of weight of bismuth-based firearm projectile 10. With this in mind, projectile body 12 additionally or alternatively may be referred to as projectile core 12, projectile interior 12, and/or projectile bulk 12. As shown, bismuth-based firearm projectile 10 also may include a coating 30 that may be applied to an exterior 28 and/or at least a portion of an exterior surface of projectile body 12. In certain embodiments, Bismuth-tin-copper alloy 14 or bismuth-nickel alloy 15 forms at least 90 weight percent (wt %) of projectile body 12, and projectile body 12 may include more than 90 wt % of bismuth-tin-copper alloy 14 or bismuth-nickel alloy 15. In embodiments, bismuth-tin-copper alloy 14 or bismuth-nickel alloy 15 may form at least one of at least 92 wt %, at least 94 wt %, at least 96 wt %, at least 98 wt %, at least 99 wt % and/or at most 100 wt % of projectile body 12. Stated differently, projectile body 12 may be formed at least substantially of, and/or entirely of, bismuth-tin-copper alloy 14 or bismuth-nickel alloy 15. In certain embodiments, the remainder of the weight of projectile body 12 may include incidental impurities, which may be present in bismuth-tin-copper alloy 14 or bismuth-nickel alloy 15, and/or one or more intentional additives, such as an anti-sparking agent and/or a lubricant. In jacketed embodiments, the bismuth-tin-copper alloy 14 or bismuth-nickel alloy 15 may form a smaller weight percentage of the projectile body 12. In such embodiments, the bismuth-tin-copper alloy 14 or bismuth-nickel alloy 15 may form at least one of at least 80 wt %, at least 70 wt %, at least 60 wt %, at least 50 wt %, at least 40 wt % of projectile body 12. In particular, for certain embodiments including small caliber rifle bullets that are jacketed, the jacket may form a higher proportion, and the bismuth alloy a lower proportion, of the bullet.

Certain embodiments of the Bismuth-tin-copper alloy 14 include an alloy of bismuth 16, tin 18, and copper 20, in which bismuth 16 forms at least 85 wt % of bismuth-tin-copper alloy 14. Other embodiments of the Bismuth-nickel alloy 15 include an alloy of bismuth 16 and nickel 17, in which bismuth 16 forms at least 90 wt % of bismuth-nickel alloy 15, and in some embodiments, bismuth 16 forms at least 95 wt % of the bismuth-nickel alloy 15. As defined herein, an alloy refers to an integrally mixed composition of two or more metals, and optionally one or more non-metals. In embodiments, an alloy as defined herein may include a solid solution of the two or more metals, a mixture of one or more alloy domains of the two or more metals, one or more metallic glasses, and/or intermetallic phases of the one or more metals. As defined herein, an alloy does not include a dispersion of one or more metals, such as a particulate or a powder of the one or more metals, which are dispersed or surrounded in a matrix metal. More specifically, an alloy as defined herein does not include compositions formed by adding a particulate of one or more metals to a molten metal without melting, dissolving, reacting, and/or otherwise integrally incorporating the particulate into the molten metal. As an example, within bismuth-tin-copper alloy 14, copper 20 may be at least substantially dissolved, reacted, or otherwise integrally incorporated in one or both of bismuth 16 and tin 18. Similarly, within bismuth-nickel alloy 15, nickel 17 may be at least substantially dissolved, reacted, or otherwise integrally incorporated in bismuth 16.

In certain embodiments, Bismuth-tin-copper alloy 14 or bismuth-nickel alloy 15 may be described as a bismuth-based alloy, a majority bismuth alloy, and/or a high-bismuth-content alloy. Stated differently, bismuth may be described as the primary metal and/or as forming a majority component of the alloy, while tin and copper and nickel may be described as forming minority or alloying components of bismuth-tin-copper alloy 14 or bismuth-nickel alloy 15. In some embodiments, Bismuth may form greater than 85 wt % of the bismuth-tin-copper alloy or bismuth-nickel alloy 15. In certain embodiments, bismuth-tin-copper alloy 14 may include at least one of at least 88 wt % bismuth, at least 90 wt % bismuth, at least 91 wt % bismuth, at least 92 wt % bismuth, at least 93 wt % bismuth, at least 94 wt % bismuth, at least 95 wt % bismuth, at least 96 wt % bismuth, at least 97 wt % bismuth, at least 98 wt % bismuth, at least 99 wt % bismuth, at most 97 wt % bismuth, at most 98 wt % bismuth, at most 98.5 wt % bismuth, and at most 99 wt % bismuth.

In certain embodiments, a bismuth-tin-copper alloy includes only bismuth, tin and copper, and no other metals or other materials. In other embodiments, a bismuth-tin-copper alloy includes only bismuth, tin and copper, and other metals or other materials at an impurity level. In still further embodiments, a bismuth-tin-copper alloy includes only bismuth, tin and copper, and other metals or other materials in an amount that is not sufficient to materially change at least one property selected from density, ductility and malleability. In certain embodiments, a bismuth-nickel alloy includes only bismuth and nickel, and no other metals or other materials. In other embodiments, a bismuth-nickel alloy includes only bismuth and nickel, and other metals or other materials at an impurity level. In still further embodiments, a bismuth-nickel alloy includes only bismuth and nickel, and other metals or other materials in an amount that is not sufficient to materially change at least one property selected from density, ductility and malleability.

In some embodiments, tin 18 and copper 20 may form the balance of the weight of bismuth-tin-copper alloy 14. Copper and tin may be present in bismuth-tin-copper alloy 14 with any selected ratio relative to bismuth and/or to one another. In particular, bismuth-tin-copper alloy 14 may comprise equal or unequal amounts or weight percentages of tin and copper. In certain embodiments, bismuth-tin-copper alloy 14 may include at least one of at least 0.5 wt % tin, at least at least 0.7 wt % tin, at least 0.8 wt % tin, at least 0.9 wt % tin, at least 1 wt % tin, at least 1.25 wt % tin, at least 1.5 wt % tin, at least 1.75 wt % tin, at least 1.8 wt % tin, at least 2 wt % tin, at least 3 wt % tin, at least 5 wt % tin, at most 1.8 wt % tin, at most 2 wt % tin, at most 2.5 wt % tin, at most 3 wt % tin, at most 5 wt % tin, at most 6 wt % tin, at most 7 wt % tin, at most 8 wt % tin, at most 9 wt % tin, at most 9.5 wt % tin, at most 9.8 wt % tin, at most 10 wt % tin, and at most 15 wt % tin. As more embodiments, bismuth-tin-copper alloy 14 may comprise at least one of at least 0.01 wt % copper, at least 0.05 wt % copper, at least 0.1 wt % copper, at least 0.12 wt % copper, at least 0.15 wt % copper, at least 0.2 wt % copper, at least 0.25 wt % copper, at least 0.3 wt % copper, at least 0.5 wt % copper, at least 0.75 wt % copper, at most 0.2 wt % copper, at most 0.25 wt % copper, at most 0.3 wt % copper, at most 0.5 wt % copper, at most 0.75 wt % copper, at most 1 wt % copper, at most 1.5 wt % copper, at most 2 wt % copper, at most 3 wt % copper, and at most 5 wt % copper.

As more specific embodiments, bismuth-tin-copper alloy 14 may include 90-99 wt % bismuth, 0.7-9.5 wt % tin, and 0.05-3 wt % copper. As yet more specific embodiments, bismuth-tin-copper alloy 14 may comprise 97-99 wt % bismuth, 0.3-2.9 wt % tin, and 0.05-0.9 wt % copper. As further specific embodiments, bismuth-tin-copper alloy 14 may comprise 97.5-98.5 wt % bismuth, 1-2.4 wt % tin, and 0.075-0.75 wt % copper.

Bismuth may form greater than 85 wt % of the bismuth-nickel alloy 15. In certain embodiments, bismuth-nickel alloy 15 may include at least one of at least 88 wt % bismuth, at least 90 wt % bismuth, at least 91 wt % bismuth, at least 92 wt % bismuth, at least 93 wt % bismuth, at least 94 wt % bismuth, at least 95 wt % bismuth, at least 96 wt % bismuth, at least 97 wt % bismuth, at least 98 wt % bismuth, at least 99 wt % bismuth, at least 99.1 wt % bismuth, at least 99.2 wt % bismuth, at least 99.3 wt % bismuth, at least 99.4 wt % bismuth, at least 99.5 wt % bismuth, at least 99.6 wt % bismuth, at least 99.7 wt % bismuth, at least 99.75 wt % bismuth, at least 99.8 wt % bismuth, at least 99.9 wt % bismuth, at most 99.9 wt % bismuth, at most 99.8 wt % bismuth, at most 99.84 wt % bismuth, at most 99.7 wt % bismuth, at most 99.5 wt % bismuth, and at most 99.9 wt % bismuth.

Nickel 17 may form the balance of the weight of bismuth-nickel alloy 15. In embodiments, bismuth-nickel alloy 15 may comprise at least one of at least 0.01 wt % nickel, at least 0.05 wt % nickel, at least 0.1 wt % nickel, at least 0.12 wt % nickel, at least 0.14 wt % nickel, at least 0.16 wt % nickel, at least 0.18 wt % nickel, at least 0.2 wt % nickel, at least 0.25 wt % nickel, at least 0.3 wt % nickel, at least 0.5 wt % nickel, at least 0.75 wt % nickel, at most 0.2 wt % nickel, at most 0.25 wt % nickel, at most 0.3 wt % nickel, at most 0.5 wt % nickel, at most 0.75 wt % nickel, at most 1 wt % nickel, at most 1.5 wt % nickel, at most 2 wt % nickel, at most 3 wt % nickel, and at most 5 wt % nickel.

In some embodiments, bismuth-nickel alloy 15 may include 90-99.9 wt % bismuth and 0.1-10 wt % nickel. As more specific embodiments, bismuth-nickel alloy 15 may include 95-99.9 wt % bismuth and 0.1-5 wt % nickel. As yet more specific embodiments, bismuth-tin-copper alloy 14 may comprise 97-99 wt % bismuth and 0.1-3 wt % nickel. As further specific embodiments, bismuth-nickel alloy 15 may comprise 99-99.9 wt % bismuth and 0.1-1 wt % nickel. As yet further specific embodiments, bismuth-nickel alloy 15 may comprise 99.2-99.9 wt % bismuth and 0.1-0.8 wt % nickel. As yet further specific embodiments, bismuth-nickel alloy 15 may comprise 99.4-99.9 wt % bismuth and 0.1-0.6 wt % nickel. As yet further specific embodiments, bismuth-nickel alloy 15 may comprise 99.5-99.84 wt % bismuth and 0.16-0.5 wt % nickel. In still further embodiments, bismuth-nickel alloy 15 may comprise 95-99.84 wt % bismuth and 0.16-5 wt %, or up to 5%, nickel.

The density of bismuth-tin-copper alloy 14, bismuth-nickel alloy 15, projectile body 12, and/or bismuth-based firearm projectile 10 may depend on such factors as the relative proportions of bismuth, tin, and copper present in the alloy and/or the conditions under which the alloy is formed. In embodiments, the density of bismuth-tin-copper alloy 14 or bismuth-nickel alloy 15, the density of projectile body 12, and/or the density of bismuth-based firearm projectile 10 may include at least one of a density of at least one of at least 9.4 grams per cubic centimeter (g/cc), at least 9.5 g/cc, at least 9.55 g/cc, at least 9.6 g/cc, at least 9.65 g/cc, at least 9.7 g/cc, at least 9.71 g/cc, at least 9.72 g/cc, at least 9.73 g/cc, at least 9.74 g/cc, at least 9.75 g/cc, at most 9.72 g/cc, at most 9.73 g/cc, at most 9.74 g/cc, at most 9.75 g/cc, at most 9.76 g/cc, and at most 9.78 g/cc.

Bismuth-tin-copper alloy 14 or bismuth-nickel alloy 15 may be described as a ballistic alloy and/or an alloy that is configured to be, and/or configured to have, properties that are optimized for use as a projectile body 12 and/or in a firearm projectile. Generally speaking, bismuth-tin-copper alloy 14 or bismuth-nickel alloy 15 compositions that include a greater proportion of bismuth will possess a greater density due to the high density of bismuth (9.78 g/cc) relative to that of tin (7.265 g/cc) and copper (8.96 g/cc) or relative to that of nickel (8.9 g/cc). A higher density projectile body 12 often is desirable for ballistic efficiency. As such, it may be desirable to maximize the amount, or relative proportion, of bismuth within bismuth-tin-copper alloy 14 or bismuth-nickel alloy 15. That said, bismuth is brittle in its elemental form, and bismuth often needs to be alloyed with another metal, such as tin, to render a bismuth composition that is adequately malleable for use as or manufacture into firearm projectiles. Conventionally, relatively large percentages of tin are used to alloy bismuth for manufacture into firearm projectiles, and the resulting alloys often remain inadequately malleable to be formed into firearm projectiles utilizing conventional techniques. Moreover, as indicated above, tin has a relatively low density, and reducing the amount or weight percentage of tin in the alloy may be desirable to produce a high-density projectile.

Bismuth-tin-copper alloys 14 or bismuth-nickel alloy 15 according to the present disclosure may include a reduced and/or lower percentage of tin and/or higher density relative to conventional bismuth-tin alloys (e.g., an alloy of 95% bismuth and 5% tin represented as 95Bi5Sn), and/or a high weight percentage of bismuth and/or high density relative to conventional bismuth-tin alloys. These improved features of bismuth-tin-copper alloy 14 or bismuth-nickel alloy 15 may be attributed to the metallurgy and/or alloying effect of copper in bismuth-tin-copper alloys 14 according to the present disclosure and/or the conditions under which bismuth-tin-copper alloys 14 or bismuth-nickel alloy 15 according to the present disclosure are formed, as discussed in more detail herein. Stated differently, the presence of copper in bismuth-tin-copper alloys 14 and/or the conditions under which bismuth-tin-copper alloys are formed and/or the conditions under which bismuth-nickel alloys are formed may produce a ballistic alloy that has a greater density, greater malleability, and/or greater ductility than conventional bismuth-tin alloys and/or may form a bismuth-based firearm projectile 10 with improved ballistic properties relative to firearm projectiles formed from conventional bismuth-tin alloys. Bismuth-tin-copper alloy 14 or bismuth-nickel alloy 15 also may possess similar improvements or advantages over other conventional bismuth-based alloys that include one or more alloying metals other than tin.

With continued reference to FIG. 1, certain embodiments of bismuth-tin-copper alloy 14 may include at least one alloy domain 38, and optionally a plurality of alloy domains 38, such as one or more tin-copper (Sn—Cu) alloy domains 42, one or more bismuth-copper (Bi—Cu) alloy domains 44, one or more bismuth-tin (Bi—Sn) alloy domains 46, and/or one or more bismuth-tin-copper (Bi—Sn—Cu) alloy domains 40. Each alloy domain 38 may be formed by the chemical reaction of, chemical interaction of, chemical bonding between, sorption of, and/or solvation of two or more of bismuth 16, tin 18, and copper 20 with one another. In certain embodiments, alloy domains 38 may include metallic bonds, such as Bi—Sn bonds, Cu—Sn bonds, and/or Bi—Cu bonds. Additionally or alternatively, bismuth-tin-copper alloy 14 also may include one or more alloy domains 38 that comprise a single metal, such as bismuth domains, tin domains, and/or copper domains. Similarly, bismuth-nickel alloy 15 may include at least one alloy domain 38, and optionally a plurality of alloy domains 38, such as one or more bismuth-nickel (Bi—Ni) domains 43. The domains 38 may include Bi—Ni bonds and/or may include a single metal, such as bismuth domains and/or nickel domains. The Bi—Ni domains 43 may be formed by chemical reaction of, chemical interaction of, chemical bonding between, sorption of, and/or solvation of bismuth and nickel with one another. In embodiments, alloy domains 43 may include metallic bonds, such as Bi—Ni bonds. Each alloy domain 38 may include various proportions of the respective metals, such as based on the relative amounts of bismuth, tin, copper, and nickel present in the alloy, the conditions under which the bismuth-tin-copper or bismuth-nickel alloy is formed, and/or the kinetics and/or thermodynamics of forming the particular alloy domain. At least a substantial proportion of bismuth, tin, and copper may be in a reduced, metallic, non-oxidized, or zero-charge state within bismuth-tin-copper alloy 14 or bismuth-nickel alloy 15. In other words, at least a substantial portion of, most of, and/or the entirety of each of bismuth, tin, and copper present in bismuth-tin-copper alloy 14 or bismuth-nickel alloy 15 may be in a reduced, metallic, non-oxidized, or zero-charge state.

Alloy domains 38 may form grains within bismuth-tin-copper alloy 14 or bismuth-nickel alloy 15. In other words, the microstructure of projectile body 12 and/or of bismuth-tin-copper alloy 14 or bismuth-nickel alloy 15 may include grains of various alloy domains 38, which may be separated from one another by grain boundaries. The presence of copper in bismuth-tin-copper alloy 14, or nickel in bismuth-nickel alloy 15, may form copper and/or copper-containing alloy domains or nickel and/or nickel-containing alloy domains that afford bismuth-tin-copper alloy 14, or nickel in bismuth-nickel alloy 15, with a greater strength, greater malleability, and/or greater ductility relative to conventional ballistic bismuth alloys and/or bismuth-tin alloys. More specifically, the copper and/or copper-containing or nickel and/or nickel-containing alloy domains may surround bismuth or bismuth-containing grains, such as to reduce the interfacial energy therebetween and increase the strength, malleability, and/or ductility of the alloy. Additionally or alternatively, the copper and/or copper-containing or nickel and/or nickel-containing alloy domains may facilitate grain refinement and/or increase grain size uniformity within bismuth-tin-copper alloy 14, which may increase the strength and/or malleability of the alloy.

As shown in FIG. 1, bismuth-tin-copper alloy 14 or bismuth-nickel alloy 15 may be a heat-treated alloy 50, which may include an annealed alloy and/or a stress-relieved alloy. More specifically, formation of bismuth-tin-copper alloy 14 may include a heat-treating process, such as the heat-treating process that is discussed in more detail herein with reference to FIG. 8 and methods 500, that may anneal, stress relieve, and/or enhance the strength of, the malleability of, the ductility of, and/or reduce the stiffness of bismuth-tin-copper alloy 14 or bismuth-nickel alloy 15.

With or without heat treatment, bismuth-tin-copper alloy 14 or bismuth-nickel alloy 15 may be more malleable, more ductile, and/or less stiff than a conventional ballistic bismuth alloy and/or a conventional ballistic bismuth-tin alloy. Stated differently, bismuth-based firearm projectile 10 and/or projectile body 12 may be more malleable, more ductile, and/or less stiff than an analogous projectile body and/or firearm projectile formed from conventional bismuth alloys and/or conventional ballistic bismuth-tin alloys. As a more specific embodiment, bismuth-tin-copper alloy 14 or bismuth-nickel alloy 15 may be adequately malleable to be formed into projectile shapes utilizing conventional forming techniques for lead-based projectiles, while conventional ballistic bismuth alloys and/or ballistic bismuth-tin alloys may be too stiff or brittle to be formed into projectile shapes utilizing these techniques. As another more specific embodiment, the stiffness, or the amount of force required to deform projectile body 12 may be less than a threshold fraction of a projectile body of equivalent shape and size that is formed from a conventional ballistic bismuth-tin alloy (95Bi5Sn alloy) that includes 95 wt % bismuth and 5 wt % tin. In certain embodiments, the stiffness of projectile body 12 may be at least 50% the stiffness of an equivalent projectile body formed from the 95Bi5Sn alloy. In other embodiments, the stiffness of projectile body 12 may be at least one of at least 30%, at least 40%, at least 50%, at least 60%, at least 70%, at most 50%, at most 60%, at most 70%, at most 80%, at most 85%, at most 90%, and at most 95% the stiffness of an equivalent projectile body formed from the 95Bi5Sn alloy. In certain embodiments of the bismuth-nickel alloy 15, the projectile body may be about 30%-70% the stiffness of an equivalent projectile body formed from 95Bi5Sn. In other embodiments of the bismuth-nickel alloy 15, the projectile body may be about 45%-55% the stiffness of an equivalent projectile body formed from 95Bi5Sn. Stiffness can be measured by any appropriate method, which is known by the person skilled in the art.

As shown in FIG. 1, certain embodiments of the bismuth-based firearm projectiles 10 may include a coating 30 that is applied to an exterior 28 of projectile body 12, typically after the formation and optionally heat treatment of bismuth-tin-copper alloy 14 or bismuth-nickel alloy 15. Embodiments of suitable coatings 30 include an oxidation-resistant coating, a corrosion-inhibiting coating, a melt-resistant coating, and/or a fouling-preventing coating. Coating 30 may be or include a metallic coating 32, which may include one metal or metal alloys, such as copper, a copper alloy, nickel, a nickel alloy, iron, an iron alloy, zinc, aluminum, tungsten, and gilding metal. Additionally or alternatively, coating 30 may be or include a non-metallic coating 36, with embodiments of non-metallic coatings including a plastic coating, a nylon coating, a polymer coating, and/or combinations thereof. Coating 30 may include a jacket coating 34, which may be a full jacket coating or a partial jacket coating. Coating 30 may be applied to projectile body 12 for increased muzzle velocity and/or to reduce the propensity of projectile body 12 to melt during firing of bismuth-based firearm projectile 10 from a firearm. Coating 30 may be applied to exterior 28 of projectile body 12 to have a uniform, homogenous, or at least substantially uniform or homogeneous, thickness over the surface of exterior 28 that coating 30 covers. When included, coating 30 may be applied to exterior 28 to have any suitable thickness. In certain embodiments, coating 30 may have a thickness that is at least one of at least 0.01 millimeters, at least 0.05 millimeters, at least 0.1 millimeters, at least 0.2 millimeters, at least 0.5 millimeters, at least 0.7 millimeters, at most 0.1 millimeters, at most 0.2 millimeters, at most 0.5 millimeters, at most 0.7 millimeters, at most 1 millimeter, and at most 2 millimeters.

When included, coating 30 may cover any suitable region, portion, or percentage of exterior 28 of projectile body 12. In some embodiments, coating 30 may cover at least some of, most of, the sides of, the nose of, and/or the entirety of exterior 28 of projectile body 12. Coating 30 also may be applied via any suitable process, such as discussed herein with reference to FIG. 8 and methods 500. For certain embodiments, when coating 30 is or includes metallic coating 32, metallic coating 32 may be applied by an electroplating process. Additionally or alternatively, when coating 30 includes a jacket coating 34, coating 30 may be applied by a jacketing process.

Figure 8:
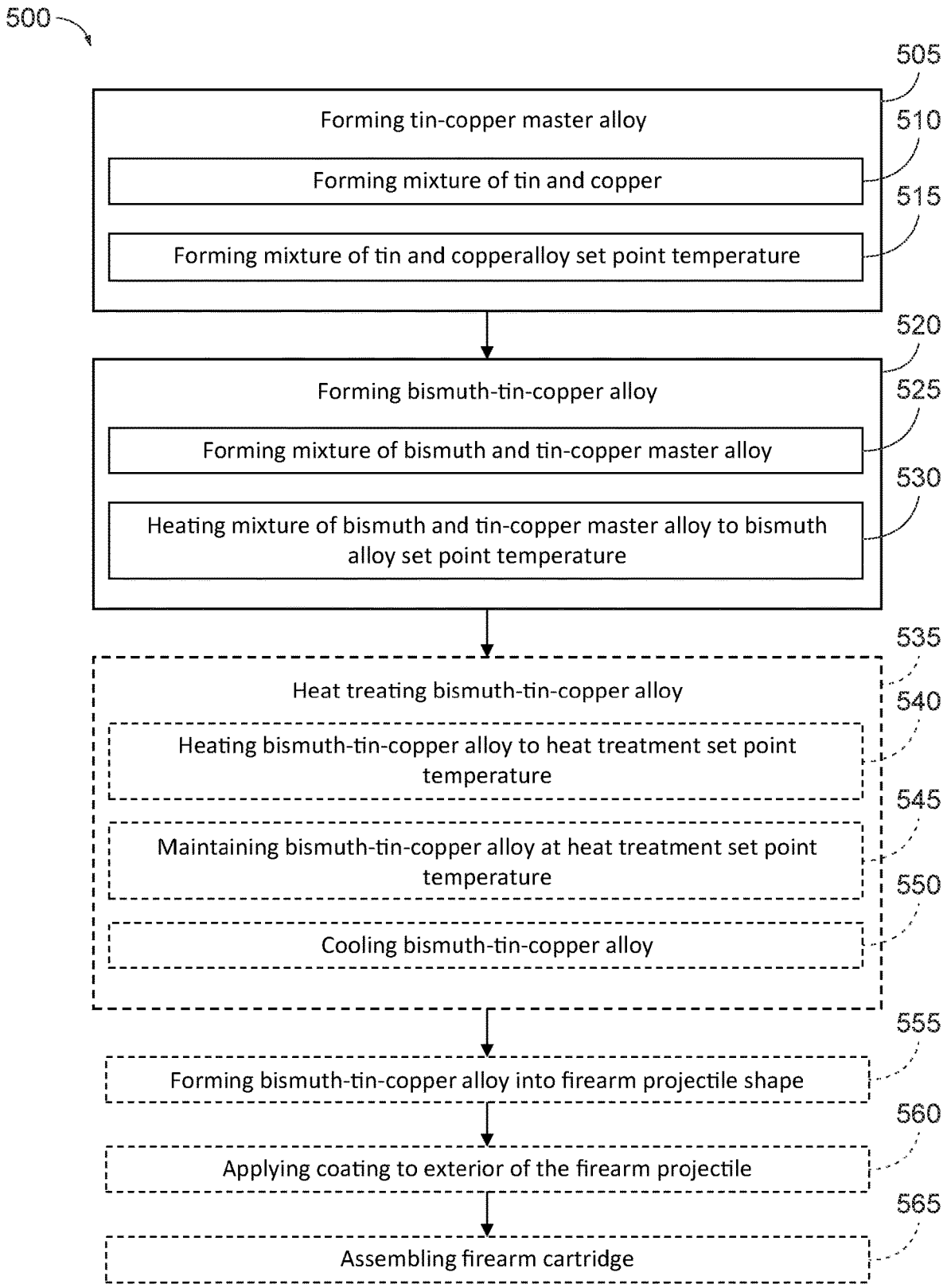
FIG. 8 is a flowchart illustrating embodiments of methods for forming bismuth-tin-copper alloys, bismuth-based firearm projectiles, and optionally firearm cartridges according to the present disclosure.

When coating 30 includes jacket coating 34, projectile body 12 and jacket coating 34 may be chemically bonded to one another, for certain embodiments, by utilizing a brazing process that is discussed in more detail herein with reference to FIG. 8 and methods 500. Chemically bonding projectile body 12 with jacket coating 34 may aid in retaining projectile body 12 within jacket coating 34 and/or may permit a bismuth-based firearm projectile 10 with a jacket coating 34 to maintain, or at least better maintain, its shape when fired from a firearm at high speeds and/or high rates of rotation or barrel twist rates. In other words, chemically bonding jacket coating 34 and projectile body 12 to one another may provide additional structural support to the projectile body, which in turn may permit the jacket-coated projectile body 12 to maintain its shape to a better degree than a corresponding projectile body 12 that does not include chemical bonding between the jacket coating and the projectile body, such as when the projectile is fired from a firearm at high speeds and/or high rates of rotation.

Projectile body 12 may form any suitable weight percentage of bismuth-based firearm projectile 10. In certain embodiments, projectile body 12 may form at least some of, a minority of, a majority of, substantially all of, and/or the entirety of the weight of bismuth-based firearm projectile 10. For some embodiments, when bismuth-based firearm projectile 10 includes coating 30, projectile body 12 and coating 30 may form at least substantially the entire weight of, or the entire weight of, bismuth-based firearm projectile 10. As more specific embodiments, projectile body 12 may form at least one of at least at least 40 wt %, at least 50 wt %, at least 60 wt %, at least 70 wt %, at least 80 wt %, at least 90 wt %, at least 95 wt %, at least 99 wt %, at most 60 wt %, at most 70 wt %, at most 80 wt %, at most 90 wt %, at most 95 wt %, at most 99 wt %, and at most 100 wt % of bismuth-based firearm projectile 10. When bismuth-based firearm projectile 10 includes less than 100 wt % projectile body 12, coating 30 may form most of, at least substantially the entirety of, and/or the entirety of the remaining weight percent of bismuth-based firearm projectile 10.

With continued reference to FIG. 1, projectile body 12 may be frangible and/or bismuth-based firearm projectile 10 may be frangible and/or referred to as a frangible firearm projectile 60. By "frangible," it is meant that a firearm projectile or projectile body is configured to break into small particulate when fired at a metal surface (such as a steel plate) at close range (such as 15 feet (4.57 meters)) from a firearm cartridge. The particulate may have a maximum particle size and/or maximum particle weight. As embodiments, the maximum particle weight may be at 1%, 3%, 5%, or 7.5% of the weight of the firearm projectile or projectile body. In particular, bismuth-tin-copper alloy 14 or bismuth-nickel alloy 15 may be configured to be frangible. When bismuth-based firearm projectile 10 comprises coating 30, the one or more materials that form coating 30 may be selected to permit bismuth-based firearm projectile 10 to be frangible as well. Additionally or alternatively, coating 30 may be applied over a selected region of exterior 28 of projectile body 12 and/or may be adequately thin to permit bismuth-based firearm projectile 10 to be frangible.

With continued reference to FIG. 1, regarding bismuth-tin-copper alloys 14 that include bismuth 16, tin 18, and copper 20, it is within the scope of the present disclosure that copper 20 may be exchanged for a third metal 22 that is different from copper 20, and the third metal 22 may be present in bismuth-tin-copper alloy 14 at the same, or substantially similar, weight percentages to those discussed herein for copper 20. Third metal 22 may possess similar, or at least substantially similar, alloying properties, or metallurgy to copper 20 and/or may contribute similar, or at least substantially similar, material properties to bismuth-tin-copper alloy 14. Alternatively, third metal 22 may possess different alloying properties or metallurgy than copper 20 but may contribute similar, or related, benefits to bismuth-tin-copper alloy 14 to those discussed herein for copper. In embodiments, third metal 22 may permit bismuth-tin-copper alloy 14 to possess an increased weight percentage of bismuth 16, a decreased weight percentage of tin 18, and/or may benefit the malleability of bismuth-tin-copper alloy 14. Additionally or alternatively, tin 18 may be exchanged for a third metal 22 that is different from tin 18, and the third metal 22 may be present in bismuth-tin-copper alloy 14 at the same, or substantially similar, weight percentages to those discussed herein for tin. Embodiments of third metal 22 include one or more of zinc, antimony, silver, and alloys thereof.

It also is within the scope of the present disclosure that bismuth-tin-copper alloy 14 may include at least a fourth metal 24, and optionally a plurality of additional metals, in addition to bismuth 16, tin 18, and copper 20. Fourth metal 24 may be present as an incidental impurity, such as may be present in commercially available supplies of bismuth, tin, and/or copper. Additionally or alternatively, bismuth 16 may be or include a bismuth alloy, tin 18 may be or include a tin alloy, and/or copper 20 may be or include a copper alloy, in which fourth metal 24 may be an alloying metal in any of bismuth 16, tin 18, and copper 20. As yet another embodiment, fourth metal 24 may be added to bismuth-tin-copper alloy 14 during the formation of the bismuth-tin-copper alloy 14. Fourth metal 24 may be added to bismuth-tin-copper alloy 14 for any suitable reason, such as to increase malleability, increase density, and/or adjust the melting point of bismuth-tin-copper alloy 14. In embodiments, fourth metal 24 may include one or more of zinc, antimony, silver, nickel, and alloys thereof. When included, fourth metal 24 may be present as a minority component of bismuth-tin-copper alloy 14, such as at similar, substantially similar, or smaller weight percentages to those discussed herein for tin 18 and copper 20. In the same manner, the bismuth-nickel alloy 15 may include a third metal 25 similar to the fourth metal 24 that may be, for example, incidentally included, an alloying metal with nickel, and/or added to bismuth-nickel alloy 15 for any suitable reason. In certain embodiments, the bismuth-nickel alloy 15 may include a third metal 25 that is copper, which may be included at any of the weight percentages described herein for copper in the bismuth-tin-copper alloy 15. Additionally or alternatively, bismuth-tin-copper alloy 14 or bismuth-nickel alloy 15 may include one or more non-metallic components, which may be present as incidental impurities and/or intentional additives, such as discussed herein. In embodiments, non-metallic components may include carbon, carbon compounds, salts, halides, phosphates, etc. In certain embodiments where a fourth metal or other additional components are added to the bismuth-tin-copper alloy 14, such additional components are counted as part of the weight percentage of the bismuth-tin-copper alloy 14.

Bismuth-based firearm projectiles 10 may have any suitable size or shape. Bismuth-based firearm projectile 10 may be designed to be loaded into a firearm cartridge 110. In particular, bismuth-based firearm projectile 10 may be configured to have a suitable size and shape for loading into a desired projectile cartridge 110. In embodiments, bismuth-based firearm projectile 10 may take the form of a bullet 100, which forms the single projectile of a firearm cartridge that is configured to be fired from a rifle or a pistol. As another embodiment, bismuth-based firearm projectile 10 may take the form of a shot slug 102, which may form the single projectile of a firearm cartridge in the form of a shot shell that is configured to be fired from a shot gun. As yet another embodiment, bismuth-based firearm projectile 10 may take the form of shot pellet 104, a plurality of which may form the projectiles of a firearm cartridge in the form of a shot shell that is configured to be fired from a shot gun. An assembled, unfired firearm cartridge 110 may be referred to as firearm ammunition 110 or ammunition 110.

Figure 2:
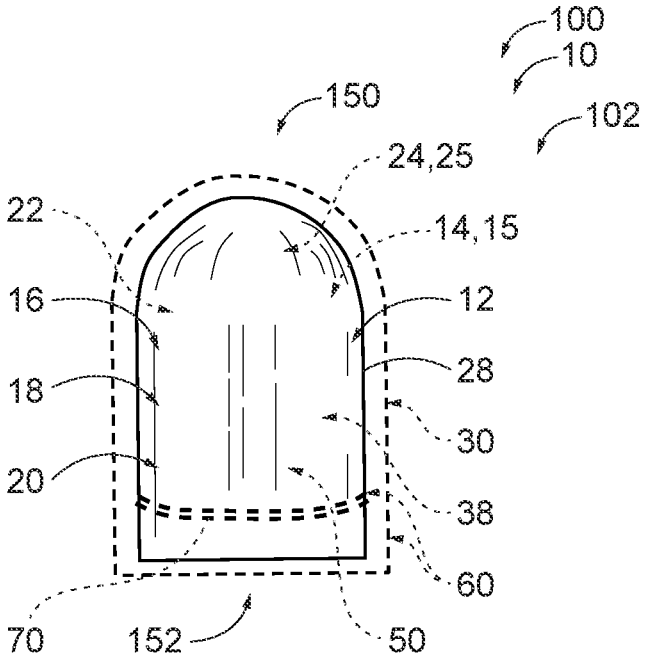
FIG. 2 is a schematic representation of embodiments of a bismuth-based firearm projectile in the form of a bullet according to the present disclosure.

FIG. 2 provides somewhat less schematic embodiments of bismuth-based firearm projectile 10 in the form of a bullet 100. As shown, bullet 100 includes projectile body 12 that includes bismuth-tin-copper alloy 14 or bismuth-nickel alloy 15. Bullet 100 includes a nose, or forward region, 150 and a base, or rearward region, 152, each of which may be defined in projectile body 12. As used herein, the nose refers to the portion of the bullet that is designed to first leave the barrel of the firearm from which bullet 100 is fired. Similarly, base 152 refers to the portion of bullet 100 that is oriented towards the primer or propellant in a firearm cartridge and thereby is the last portion to leave the firearm barrel. Bullet 100 also may include coating 30 applied to the exterior of projectile body 12, and coating 30 may be or include any of the coatings 30 discussed herein such as one or more of a jacket coating, a metallic coating, and/or a non-metallic coating. Bullet 100 also may include a cannelure 70, which may be formed within coating 30 and/or projectile body 12.

Bullets 100 and projectile bodies 12 thereof according to the present disclosure may include different shapes than are illustrated in FIG. 2, with FIG. 2 intended simply to be a schematic representation of such bullets 100 and projectile bodies 12. In embodiments, bullet 100 may be longer, may have a more pointed nose, may have a recessed nose, etc. Thus, it is within the scope of the present disclosure that bullet 100 may take any suitable shape and/or configuration, such as those known in the art for conventional bullets.

Bullet 100 may be formed by any suitable process, such as discussed in more detail herein with reference to FIG. 8 and methods 500. In embodiments, bullet 100 may be formed by casting, forging, swaging, and/or compacting bismuth-tin-copper alloy 14 or bismuth-nickel alloy 15.

Figure 3:
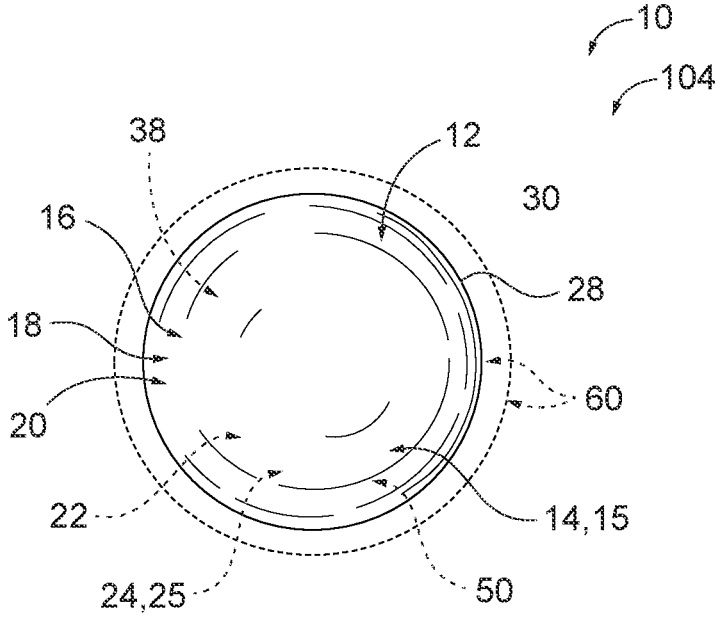
FIG. 3 is a schematic representation of embodiments of a bismuth-based firearm projectile in the form of a shot pellet according to the present disclosure.
Figure 4:
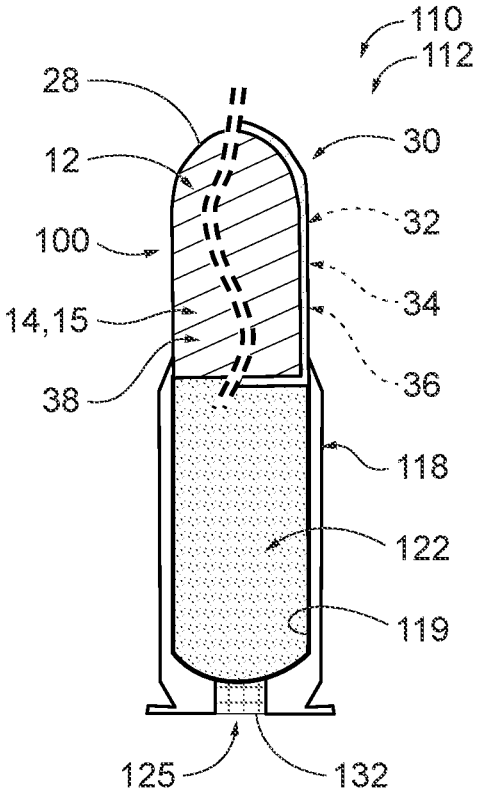
FIG. 4 is a schematic representation of embodiments of a firearm cartridge in the form of a bullet cartridge that includes a bismuth-based firearm projectile in the form of a bullet according to the present disclosure.

FIG. 3 provides a schematic illustration of embodiments of a bismuth-based firearm projectile 10 in the form of a shot pellet 104. As shown, shot pellet 104 includes a projectile body 12 that is at least substantially formed from bismuth-tin-copper alloy 14 or bismuth-nickel alloy 15. Shot pellet 104 optionally may include coating 30, such as any of the coatings 30 discussed herein, that is applied to the exterior 28 of projectile body 12. Shot pellet 104 and projectile body 12 are illustrated in FIG. 4 as having a spherical configuration, but other shapes may be utilized. Embodiments of non-spherical shot pellet shapes include teardrop shapes, ovoid/elliptical shapes, ogived shapes, boat tail shapes, shapes that include a projecting tail region, shapes with one or more planar/faceted portions, and/or spherical shapes that include a center cylindrical band. Thus, it is within the scope of the present disclosure that shot pellet 104 may take any suitable shape and/or configuration, such as those known in the art for conventional shot pellets.

FIG. 4 is a schematic cross-sectional view showing an embodiment of a firearm cartridge 110 that includes a bismuth-based firearm projectile 10 in the form of a bullet 100 according to the present disclosure. A firearm cartridge 110 that includes a bullet may be referred to as a bullet cartridge 112. Bullet cartridge 112 includes a casing, or a housing, 118. Casing 118 includes a cup, or cup region, 119, and defines an internal volume in which a propellant 122 is located. Propellant 122 also may be referred to as powder 122, smokeless powder 122, gun powder 122, and/or charge 122. Bullet cartridge 112 additionally includes an ignition device 125, such as a primer, or priming mixture, 132, which may be configured to ignite propellant 122. Casing 118, primer 132, and propellant 122 may be of any suitable materials, as are known in the firearm and ammunition fields. As shown indicated by the cutline in FIG. 4, bismuth-based firearm projectile 10 may or may not include coating 30. In either case, bismuth-based firearm projectile 10 may be dimensioned, or otherwise configured, to be received within casing 118. In some embodiments, when coating 30 is applied to exterior 28 of projectile body 12, projectile body 12 may be intentionally under-dimensioned such that bismuth-based firearm projectile 10 may fit properly within casing 118 with the additional width that may be added by coating 30.

Bullet cartridge 112 is configured to be loaded into a firearm, such as a handgun, rifle, or the like, and upon firing, discharges bullet 100 at high speeds and with a high rate of rotation due to rifling within the firearm's barrel. Although bullet cartridge 112 is illustrated in FIG. 4 as a centerfire cartridge, in which primer 132 is located at the center of a base of casing 118, bullets 100 according to the present disclosure also may be incorporated into other types of cartridges, such as rimfire cartridges, in which the casing is rimmed or flanged and the primer is located inside the rim of the casing.

Figure 5:
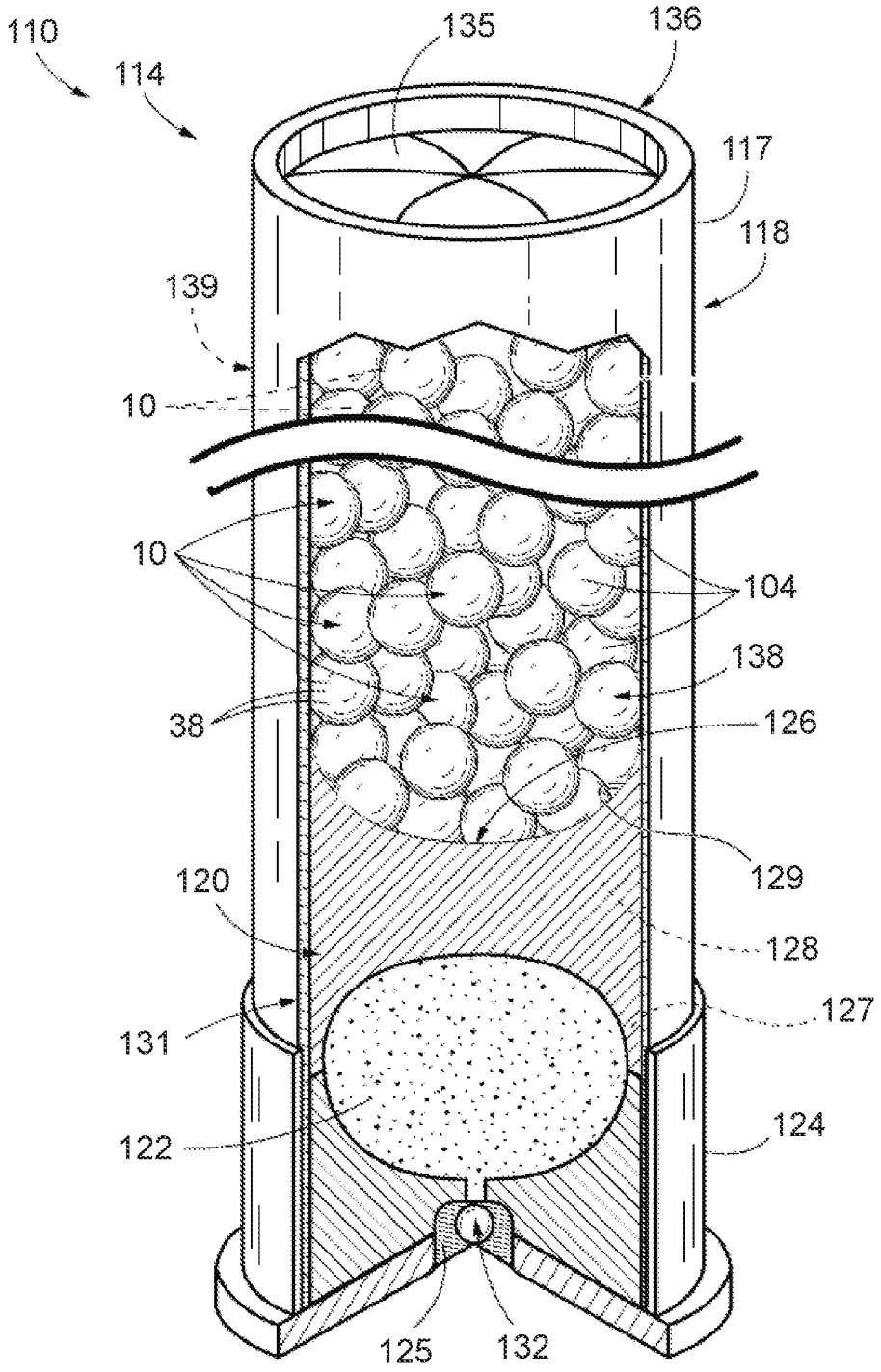
FIG. 5 is a schematic representation of embodiments of a firearm cartridge in the form of a shot shell that contains a plurality of bismuth-based firearm projectiles in the form of shot pellets according to the present disclosure.

FIG. 5 is a schematic illustration of a firearm cartridge 110 according to embodiments of the present disclosure that includes a plurality of bismuth-based firearm projectiles 10 in the form of shot pellets 104 according to the present disclosure. A firearm cartridge 110 that includes at least one shot pellet 104 may be referred to as a shot shell 114. As shown, shot shell 114 includes a casing, or housing, 118, with a head portion 124, a hull portion 117, and a mouth region 136. Shot shell 114 further includes an ignition device 125, such as a primer, or a priming mixture, 132, which may be configured to ignite a propellant 122. Propellant 122 and primer 132 may be located behind a partition 120, such as a wad 131, which serves to segregate propellant 122 and primer 132 from a payload 138 of shot shell 114 and which may provide a gas seal to impede the flow of propellant gasses during firing of shot shell 114.

Wad 131 defines a pellet-facing surface 129 that extends and/or faces generally toward mouth region 136 and away from head portion 124 (when the wad is positioned properly within an assembled shot shell). Wad 131 may include at least one gas seal, or gas seal region, 127, and at least one deformable region 128 between the payload region 139 and the propellant 122. Gas seal region 127 is configured to engage the inner surface of the shotgun's chamber and barrel to restrict the passage of gasses, which are produced when the shot shell is fired (i.e., when the charge is ignited), along the shotgun's barrel. By doing so, the gasses propel the wad, and the payload 138 of shot pellets 104 contained therein, from the chamber and along and out of the shotgun's barrel. Deformable region 128 is designed to crumple, collapse, or otherwise non-elastically deform in response to the setback, or firing, forces that are generated when the shot shell is fired, and the combustion of the propellant rapidly urges the wad and payload from being stationary to travelling down the barrel of the shotgun at high speeds.

A shot shell 114 may include as few as a single shot pellet 104, which perhaps more appropriately may be referred to as a shot slug, and as many as dozens or hundreds of individual shot pellets 104. The number of shot pellets 104 in any particular shot shell 114 will be defined by such factors as the size and geometry of the shot pellets, the size and shape of the shell's casing and/or wad, the available volume in the casing to be filled by shot pellets 104, etc. For example, a 12-gauge double ought (00) buckshot shell typically contains nine shot pellets having diameters of approximately 0.3 inches (0.762 cm), while shot shells that are intended for use in hunting birds, and especially smaller birds, tend to contain many more shot pellets.

As discussed, shot shell 114 is designed and/or configured to be placed within a firearm, such as a shotgun, and to fire payload 138 therefrom. In embodiments, a firing pin of the firearm may strike primer 132, which may ignite propellant 122. Ignition of propellant 122 may produce gasses that may expand and provide a motive force to propel the one or more shot pellets 104 forming payload 138 from the firearm (or a barrel thereof).

Shot shell 114 and its components have been illustrated schematically in FIG. 5 and are not intended to require a specific shape, size, or quantity of the components thereof. The length and diameter of the overall shot shell 114 and its casing 118, the amount of primer 132 and propellant 122, the shape, size, and configuration of wad 131, the type, shape, size, and/or number of shot pellets 104, etc. all may vary within the scope of the present disclosure.

Figure 6:
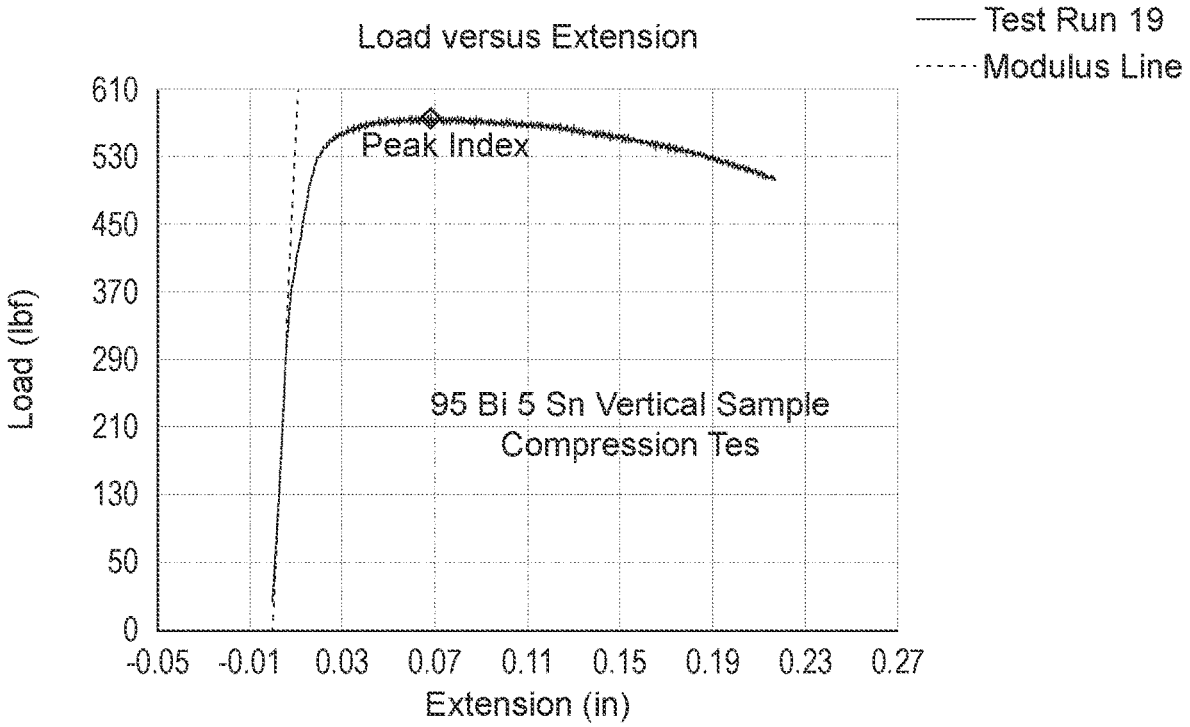
FIG. 6 displays the results of a compression test performed on a conventional bismuth-tin alloy.
Figure 7:
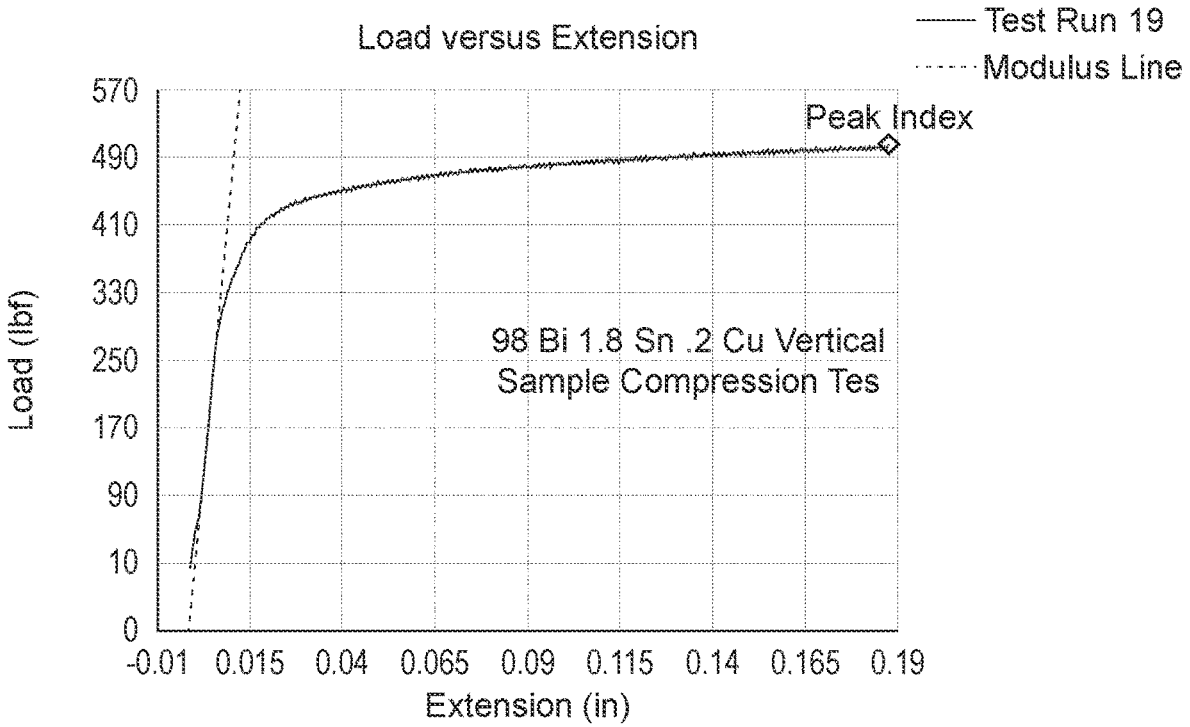
FIG. 7 displays the results of a compression test performed on a bismuth-tin-copper alloy, according to the present disclosure.

Turning now to FIGS. 6 and 7, results are shown of compression tests performed on a conventional bismuth-tin alloy and an embodiment of a bismuth-tin-copper alloy 14 according to the present disclosure. In particular, FIG. 6 shows a stress-strain curve collected from a vertical compression test on a conventional bismuth-tin alloy that contains 95 wt % bismuth and 5 wt % tin alloy, and FIG. 7 shows a stress-strain curve collected from a vertical compression test of a heat-treated bismuth-tin-copper alloy 14 that contains 90 wt % bismuth, 1.8 wt % tin, and 0.2 wt % copper. The data shown in FIGS. 6 and 7 were collected using an MTS model E43 electromechanical test system, and each compression test was performed on a cylinder of the respective alloy having a length of 1.057 inches (2.685 centimeters (cm)) and a diameter of 0.2 inches (0.508 cm). The test cylinders were placed in the compression test unit vertically, such that compression was applied along the length of the cylinder and traverse to the diameter of the cylinder. The compression rate was 0.01 inches per second (0.0254 cm per second), and the tests were stopped at approximately 0.19 inches (0.48 cm) of compression. The applied force shown on the Y-axis is displayed in units of pound-force, and the X-axis displays deflection from the initial length in inches.

The test results shown in FIGS. 6-7 demonstrate a significant difference in malleability and ductility between the two bismuth alloys. FIG. 6 shows the conventional bismuth-tin alloy exhibiting a yield strength of approximately 560 pound-force (2491 Newtons), which corresponds to 17.8 Kpsi (123 MPa), while FIG. 7 shows an embodiment of the bismuth-tin-copper alloy 14 exhibiting a yield strength of 430 pound-force (1912 Newtons), which corresponds to 13.7 Kpsi (94.3 MPa). More specifically, these results show bismuth-tin-copper alloy 14 exhibiting approximately a 23% reduction in yield strength compared to the conventional bismuth-tin alloy. In other words, the significantly lower yield strength of the bismuth-tin-copper alloy 14 shows that less force is required to cause the bismuth-tin-copper alloy to yield or permanently deform relative to the conventional bismuth-tin alloy. This indicates that bismuth-tin-copper alloy 14 is more malleable than the conventional bismuth-tin alloy.

The response of bismuth-tin-copper alloy 14 to a compressive load beyond the yield strength or yield point supports attribution of the lower yield strength of bismuth-tin-copper alloy 14 to the greater malleability of bismuth-tin-copper alloy 14 relative to the conventional bismuth-tin alloy. More specifically, as shown in FIG. 7, the compression load continues to increase beyond the yield point or yield strength of bismuth-tin-copper alloy 14 until the test was terminated at 0.19 inches (0.48 centimeters) of compression. This result indicates that the bismuth-tin-copper alloy undergoes plastic deformation without failing beyond the yield strength. By contrast, as shown in FIG. 6, the compression load supported by the conventional bismuth-tin alloy began to decrease beyond the yield point or yield strength at ~0.07 inches (0.18 cm) of deflection, which indicates the beginning of material failure. Material failure was confirmed by the observation of a significant fracture (~25% of the diameter) in the conventional bismuth-tin alloy test cylinder following the compression test. Thus, these results confirm the improved malleability of bismuth-tin-copper alloy relative to the conventional bismuth-tin alloy and may further indicate that bismuth-tin-copper alloy 14 possesses improved ductility characteristics relative to the conventional bismuth-tin alloy.

As mentioned, the compression test results displayed in FIG. 7 were collected on a specific embodiment of a bismuth-tin-copper alloy 14. In other words, the results shown in FIG. 7 were collected on an illustrative, non-exclusive embodiment of a bismuth-tin-copper alloy 14, and bismuth-tin-copper alloys 14 according to the present disclosure are not limited to the specific characteristics and/or material properties demonstrated and discussed herein with reference to FIG. 7. In particular, bismuth-tin-copper alloys 14 may exhibit similar, substantially similar, or different characteristics and/or material properties to those demonstrated in FIG. 7, such as depending on the specific composition of the bismuth-tin-copper alloy and/or the conditions under which the alloy is formed. In embodiments, bismuth-tin-copper alloy 14 may possess a greater or lower reduction in yield strength compared to the results demonstrated in FIG. 7. In embodiments, bismuth-tin-copper alloy 14 may exhibit at least one of at least 10%, at least 15%, at least 25%, at least 30%, at least 40%, at most 50%, and at most 75% reduction in yield strength relative to the conventional bismuth-tin alloy. That said, in general, bismuth-tin-copper alloys 14 according to the present disclosure may exhibit plastic deformation beyond the yield point, as shown and discussed herein with reference to FIG. 7.

Figure 10:
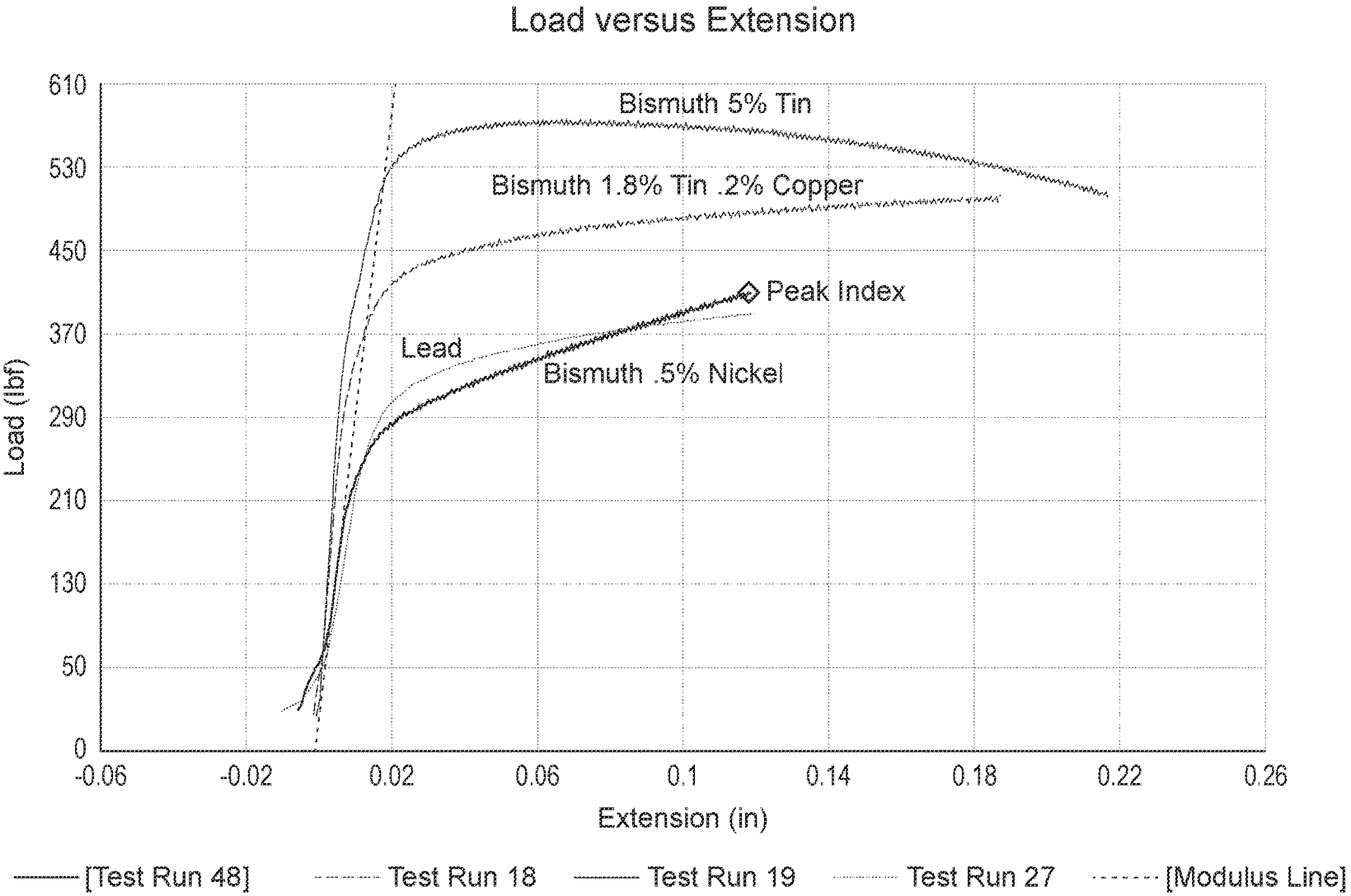
FIG. 10 displays the results of a compression test performed on a bismuth-nickel alloy and a bismuth-tin-copper alloy according to embodiments of the present disclosure, in addition to tests performed on a conventional bismuth-tin alloy and lead.

Turning now to FIG. 10, results are shown of compression tests performed on a conventional lead, a conventional bismuth-tin alloy, an embodiment of the bismuth-tin-copper alloy 14 according to the present disclosure, and an embodiment of the bismuth-nickel alloy 15 according to the present disclosure. In particular, FIG. 10 shows a load vs. compression curve collected from a test on a bismuth-nickel alloy 15 that contains 99.5 wt % bismuth and 0.5 wt % nickel. The data shown in FIG. 10 was collected using the same testing equipment and parameters as discussed above with reference to FIGS. 6 and 7. The applied force shown on the Y-axis is displayed in units of pound-force (lbf), and the X-axis displays extension from the initial length in inches.

The test results shown in FIG. 10 demonstrate that the bismuth-tin-copper alloy 14 (1.8% Sn 0.2 wt % Cu in this embodiment) and bismuth-nickel alloy 15 (0.5 wt % Ni in this embodiment) compare closely with lead and a conventional bismuth-tin alloy (95Bi5Sn) in malleability and ductility. In particular, the results of FIG. 10 demonstrate the point of the compression load test when the specimen begins to deform or yield under a given load: the lead specimen yielded at approximately 290 lbf, whereas the bismuth-nickel alloy 15 yielded at approximately 250 lbf, resulting in approximately 14% less force for the bismuth-nickel alloy 15 specimen to deform. In other embodiments, the bismuth-nickel alloy 15 may yield at a lower force than lead, the lower force ranging from 5-40%, 5-25%, and 10-20% less force. Accordingly, the bismuth-nickel alloy 15 is more malleable than lead. The conventional bismuth-tin shown in FIG. 10 did not begin to deform and yield until approximately 530 lbf was applied to the specimen. Subsequently, the load began to decrease shortly after the deformation began, indicating that the specimen began to fracture as the deformation of the specimen increased. This demonstrates undesirable malleability properties. Compare this result with the bismuth-tin-copper alloy 14 that yielded at approximately 380 lbf and the bismuth-nickel alloy 15 that yielded at approximately 250 lbf. These loads are significantly lower than the force needed to deform the conventional bismuth-tin material and are closer to the lead which yielded at approximately 290 lbf. Moreover, the compression curves for the bismuth-tin-copper alloy 14 and the bismuth-nickel alloy 15 continue to increase as deformation increases, which indicates that these material specimens are absent of fracturing and are malleable.

Across the tested range of loads from about 0-400 lbf, the compression length of the bismuth-tin-copper alloy 14 and the bismuth-nickel alloy 15 are comparable with lead and the conventional bismuth-tin alloy 95Bi5Sn. As shown, the bismuth-tin-copper alloy 14 performs more closely to lead than the conventional bismuth-tin, and the bismuth-nickel alloy 15 performs even more closely to lead. The bismuth-nickel alloy 15 exhibits compression lengths substantially similar to lead along the range of loads.

As mentioned, the compression test results displayed in FIG. 10 were collected on a specific embodiment of a bismuth-nickel alloy 15. In other words, the results shown in FIG. 10 were collected on an illustrative, non-exclusive embodiment of a bismuth-nickel alloy 15, and bismuth-nickel alloys 15 according to the present disclosure are not limited to the specific characteristics and/or material properties demonstrated and discussed herein with reference to FIG. 10. In particular, bismuth-nickel alloys 15 may exhibit similar, substantially similar, or different characteristics and/or material properties to those demonstrated in FIG. 10, such as depending on the specific composition of the bismuth-nickel alloy and/or the conditions under which the alloy is formed. In embodiments, bismuth-nickel alloy 15 may possess a greater or lower compression and malleability compared to the results demonstrated in FIG. 10. That said, in general, bismuth-nickel alloys 15 according to the present disclosure may exhibit malleability and ductility that compare closely with lead, as shown and discussed herein with reference to FIG. 10. FIG. 8 is a flowchart schematically representing embodiments of methods 500 for forming bismuth-based firearm projectiles, and optionally firearm cartridges including the same, according to the present disclosure.

Figure 9:
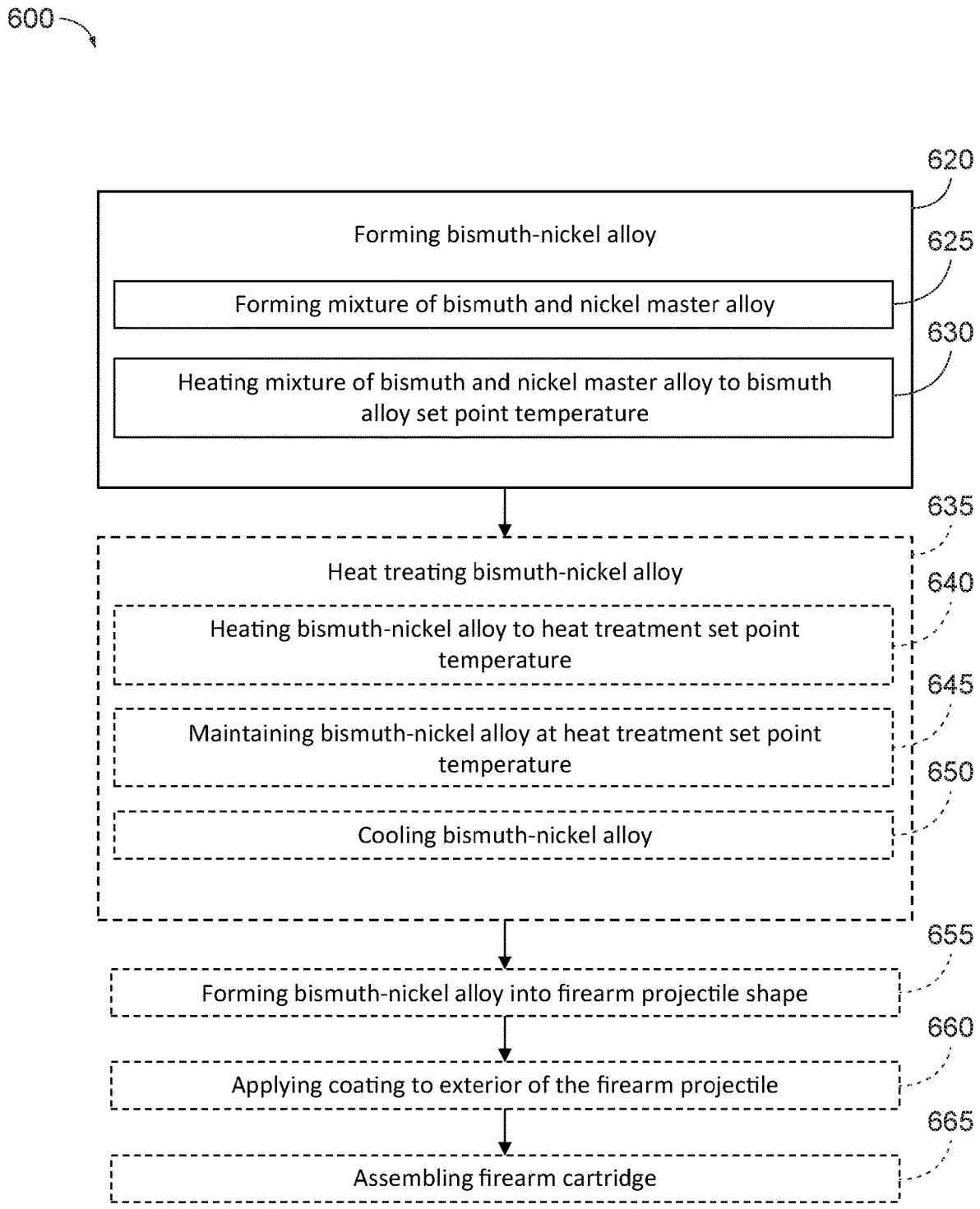
FIG. 9 is a flowchart illustrating embodiments of methods for forming bismuth-nickel alloys, bismuth-based firearm projectiles, and optionally firearm cartridges according to the present disclosure.

Similarly, FIG. 9 is a flowchart schematically representing embodiments of methods 600 for forming bismuth-based firearm projectiles, and optionally firearm cartridges including the same, according to the present disclosure. Methods 500, 600 for forming bismuth-based firearm projectiles additionally or alternatively may be described as methods 500, 600 for forming bismuth-tin-copper alloys or bismuth-nickel alloys that may be utilized to form firearm projectiles. Methods 500, 600 presented in FIGS. 8 and 9 may be utilized to form the bismuth-based firearm projectiles and the firearm cartridges including the bismuth-based firearm projectiles that are discussed herein with reference to FIGS. 1-7 and 10. Stated differently, the bismuth-based firearm projectiles and/or the firearm cartridges including the bismuth-based firearm projectiles that are discussed herein with reference to FIGS. 1-7 and 10 may be produced by performing one or more steps of methods 500, 600 and may include any of the features, functions, components, attributes, aspects, characteristics, properties, etc. that are discussed herein with reference to FIG. 8 and methods 500 or FIG. 9 and methods 600 without requiring inclusion of all such features, functions, components, attributes, aspects, characteristics, properties, etc. Likewise, the bismuth-based firearm projectiles and/or firearm cartridges including bismuth-based firearm projectiles that are formed by performing methods 500, 600 and/or portions thereof and/or that are discussed herein with reference to FIG. 8 or 9 may be the bismuth-based firearm projectiles and/or the firearm cartridges including the bismuth-based firearm projectiles that are discussed herein with reference to FIGS. 1-7 and 10 and/or may include any of the features, functions, components, attributes, aspects, characteristics, properties, etc. of the bismuth-based firearm projectiles and/or the firearm cartridges including the bismuth-based firearm projectiles that are discussed herein with reference to FIGS. 1-7 and 10, without requiring inclusion of all such features, functions, components, attributes, aspects, characteristics, properties, etc. That said, methods 500, 600 may be utilized to produce firearm projectiles and/or firearm cartridges other than those discussed herein with reference to FIGS. 1-7 and 10 without departing from the scope of the present disclosure. Likewise, the bismuth-based firearm projectiles and/or the firearm cartridges including the bismuth-based firearm projectiles that are discussed herein with reference to FIGS. 1-7 and 10 may be produced by methods other than those illustrated and discussed herein with reference to FIGS. 8 and 9 without departing from the scope of the present disclosure.

Methods 500, 600 illustrated and discussed herein with reference to FIGS. 8 and 9 are not intended to be exhaustive for production of all bismuth-based firearm projectiles and/or firearm cartridges including the same. Similarly, methods 500, 600 may include additional steps and/or substeps and/or may include fewer steps than those illustrated in FIGS. 8 and 9 without departing from the scope of the present disclosure. Unless a particular step must be completed to enable a subsequent step to be performed, the embodiments of steps shown and/or discussed in connection with FIGS. 8 and 9 may be performed in any suitable concurrent and/or sequential order. In FIGS. 8 and 9, some steps are illustrated in dashed boxes, indicating that such steps may be optional or may correspond to an optional version of methods 500, 600. That said, not all methods 500, 600 are required to include the steps illustrated in solid boxes.

As shown in FIG. 8, methods 500 include forming a tin-copper master alloy at 505, which includes forming a mixture of tin and copper at 510, and heating the mixture of tin and copper to a master alloy set point temperature at 515. Methods 500 further include forming a bismuth-tin-copper alloy at 520, which includes forming a mixture of bismuth and the tin-copper master alloy at 525, and heating the mixture of bismuth and the tin-copper master alloy to a bismuth alloy set point temperature at 530. Methods 500 optionally include heat treating the bismuth-tin-copper alloy at 535, which may include heating the bismuth-tin-copper alloy to a heat treatment set point temperature at 540, optionally maintaining the bismuth-tin-copper alloy at a heat treatment maintaining temperature at 545, and optionally cooling the bismuth-tin-copper alloy at 550. Methods 500 further may include forming the bismuth-tin-copper alloy into a firearm projectile shape at 555, optionally applying a coating to an exterior of the bismuth-based firearm projectile at 560, and optionally assembling a firearm cartridge that includes the bismuth-based firearm projectile at 565.

Forming the tin-copper master alloy at 505 additionally or alternatively may be referred to as alloying copper and tin to form the tin-copper master alloy at 505. The forming the tin-copper master alloy at 505 may include combining, intermixing, alloying, and/or reacting tin and copper with one another. As more specific embodiments, the forming the tin-copper master alloy at 505 may include forming a homogenous liquid mixture of tin and copper, and further may include cooling the homogenous liquid mixture of tin and copper to form a homogenous solid mixture of tin and copper. Additionally or alternatively, the forming the tin-copper alloy may include dissolving at least a portion of the copper into the tin, dissolving at least a substantial portion of the copper into the tin, and/or dissolving the entirety of the copper into the tin. Additionally or alternately, the forming at 505 may include dissolving at least a portion of the tin into the copper. The forming the tin-copper master alloy at 505 may include forming one or more tin-copper (Sn—Cu) alloy phases, forming one or more Sn—Cu alloy domains, and/or forming Sn—Cu metallic bonds.

The forming the tin-copper master alloy at 505 also may include increasing the solubility of copper in bismuth, and/or increasing the miscibility of copper with bismuth. More specifically, pure or non-alloyed copper has a high melting point relative to bismuth and low solubility in molten bismuth, which makes alloying bismuth directly with copper difficult. While the solubility of copper in bismuth increases with temperature, bismuth generally will oxidize at temperatures that are great enough to adequately dissolve copper in bismuth. By contrast, copper is readily alloyed with tin at temperatures low enough to avoid oxidation of tin and copper. Tin has a relatively low melting point and high solubility in molten bismuth. With this in mind, alloying copper with tin to form the tin-copper alloy may provide a solubility-increasing matrix to copper and/or render copper in a more bismuth-soluble and/or more bismuth-miscible form that permits copper to be alloyed with bismuth, such as at lower temperatures and without oxidation. Stated another way, forming the tin-copper master alloy at 505 prior to incorporating tin or copper into bismuth may permit the forming the bismuth-tin-copper alloy to form a true alloy of bismuth, tin, and copper, rather than a dispersion of copper in bismuth and/or tin, and/or may reduce the propensity for oxidation of bismuth and/or copper to occur during heating the mixture of bismuth and the tin-copper master alloy at 530.

The forming the tin-copper master alloy at 505 may include forming a tin-copper master alloy with any suitable weight percentage of tin and copper. For example, the forming the tin-copper master alloy may include forming a tin-copper alloy that includes tin as a majority component and copper as a minority component. In embodiments, the forming at 505 may include forming a tin-copper master alloy that includes at least one of at least 5 wt % copper, at least 6 wt % copper, at least 7 wt % copper, at least 9 wt % copper, at least 10 wt % copper, at least 15 wt % copper, at least 20 wt % copper, at most 10 wt % copper, at most 15 wt % copper, at most 20 wt % copper, and at most 30 wt % copper. As more embodiments, the forming the tin-copper master alloy may include forming a tin-copper master alloy that includes at least one of at least 70 wt % tin, at least 80 wt % tin, at least 85 wt % tin, at least 90 wt % tin, at least 91 wt % tin, at least 93 wt % tin, at least 94 wt % tin, at most 80 wt % tin, at most 85 wt % tin, at most 90 wt % tin, at most 91 wt % tin, at most 93 wt % tin, at most 94 wt % tin, and at most 95 wt % tin. As a more specific embodiment, the forming the tin-copper master alloy at 505 may include forming a tin-copper alloy that includes 70-95 wt % tin and 5-30 wt % copper.

As discussed herein, copper may be exchanged for a third metal that is different from copper in the bismuth-tin-copper alloy and/or tin may be exchanged for a third metal that is different from tin in the bismuth-tin-copper alloy. In such embodiments, the third metal may be present in the master alloy at similar or at least substantially similar weight percentages to those discussed herein for tin and copper, respectively. With this in mind, the forming the tin-copper alloy alternatively may include forming a mixture of copper and a third metal that is different from tin or forming a mixture of tin and a third metal that is different from copper. In such embodiments, the forming the tin-copper master alloy may include reacting dissolving, and/or intermixing tin or copper with the third metal, such as discussed herein for tin and copper. Additionally or alternatively, as disused herein, the bismuth-tin-copper alloy may include a fourth metal. As such, the forming the tin-copper alloy may include forming an alloy of tin, copper, and the third metal, which may include reacting, dissolving, and/or intermixing tin, copper, and the fourth metal, such as discussed herein for tin and copper.

The forming the tin-copper master alloy at 505 may be performed with any suitable sequence or timing within methods 500, such as prior to forming the bismuth-tin-copper alloy at 520 and/or prior to heat treating the bismuth-tin-copper alloy at 535.

As shown in FIG. 8, the forming the tin-copper master alloy at 505 includes forming a mixture of tin and copper at 510. The forming the mixture of tin and copper at 510 includes combining tin and copper to form the mixture of tin and copper. Tin and copper may be in any suitable phase, form, and/or dimension during the forming the mixture of tin and copper at 510. In some embodiments, the forming the mixture of tin and copper at 510 may include combining solids of tin and copper, such as powders of tin and copper and/or bulk pieces of tin and copper. More specifically, the forming the mixture of tin and copper at 510 may include mixing a powder of copper and a powder of tin to form a powdered mixture of tin and copper. Additionally or alternatively, the forming the mixture of tin and copper at 510 may include adding a solid of one of the copper and tin to a molten or liquid phase of the other of tin and copper. As a more specific embodiment, the forming the mixture of tin and copper at 510 may include adding a solid quantity of copper, such as a powder of copper or a bulk piece of copper, to a molten phase of tin. As yet another embodiment, the forming the mixture of tin and copper at 510 may include combining a molten or liquid phase of copper with a molten or liquid phase of tin.

When the forming the mixture of tin and copper at 510 includes utilizing a liquid or molten phase of tin and/or copper, the forming the mixture of tin and copper at 510 may include heating one or more of the tin and copper to or above the melting point of the respective metal(s) to form the liquid or molten phase of the respective metal(s). In some embodiments, the forming the mixture of tin and copper at 510 may include heating a quantity of tin to above its melting point and/or at least 231.9 degrees Celsius (° C.) (449.5 degrees Fahrenheit (° F.)) to melt the tin and adding a solid quantity of copper, such as a powder of copper and/or a bulk piece of copper to the molten tin.

The forming the mixture of tin and copper at 510 further may include dispersing the tin and copper amongst one another, such as by mechanically agitating or stirring the copper and/or tin with one another. The forming the mixture of tin at 510 may include combining tin and copper in a predetermined ratio and/or relative amounts, such as to produce a copper-tin master alloy having any composition of copper and tin, such as any of the compositions discussed herein with reference to the forming at 505.

The forming the mixture of tin and copper at 510 may be performed with any suitable sequence or timing within methods 500. In embodiments, the forming the mixture of tin and copper at 510 may be performed prior to or substantially simultaneously with heating the mixture of tin and copper at 515 and/or prior to the forming the bismuth-tin-copper alloy at 520.

With continued reference to FIG. 8, the forming the tin-copper master alloy includes heating the mixture of tin and copper to a master alloy set point temperature at 515. In particular, the heating at 515 may include heating the mixture of tin and copper to a master alloy set point temperature that is adequate to alloy the tin with the copper, at least substantially dissolve the copper within the tin, react the tin with the copper, and/or form a homogeneous liquid mixture of tin and copper. With this in mind, the master alloy set point temperature may be at least the melting point of tin or at least the melting point of the mixture of tin and copper, which may vary depending on the relative amounts of tin and copper contained within the mixture. In embodiments, the master alloy set point temperature may include at least one of at least 300° C., at least 350° C., at least 400° C., at least 450° C., at least 475° C., at least 500° C., at least 510° C., at least 520° C., at least 550° C., at most 500° C., at most 510° C., at most 520° C., at most 550° C., at most 575° C., at most 600° C., at most 700° C., at most 800° C., and/or at most 900° C. As discussed herein, the master alloy set point temperature may be or include a temperature range such as defined within any of the temperatures listed above.

The heating the mixture of tin and copper at 515 may be performed in a temperature-controlled environment and/or a thermally controlled device such as a thermally regulated furnace or oven. The heating the mixture of tin and copper at 515 may include and/or be performed as a portion of the forming the mixture of tin and copper at 510. In various embodiments, when the forming the mixture of tin and copper at 510 includes combining solids of tin and copper and/or adding a solid of copper to a molten tin, the heating the mixture of tin and copper at 515 may further and/or completely mix the tin and copper with one another, such as by supplying the heat that is required to melt at least the tin, dissolve the copper within the tin, and/or form a homogenous liquid mixture of the tin and copper.

The heating at 515 may include maintaining the mixture of tin and copper at the master alloy set point temperature for a master alloying time. In particular, the heating at 515 may include maintaining the mixture of tin and copper at the master alloy set point temperature for a master alloy time that is adequate to alloy the tin with the copper, at least substantially dissolve the copper within the tin, react the tin with the copper, and/or form a homogeneous liquid mixture of tin and copper. In embodiments, the master alloy time may include at least one of at least 30 minutes, at least 60 minutes, at least 120 minutes, at least 180 minutes, at least 240 minutes, at least 300 minutes, at least 360 minutes, at most 120 minutes, at most 180 minutes, at most 240 minutes, at most 300 minutes, at most 360 minutes, and at most 480 minutes.

The heating the mixture of tin and copper at 515 may be performed without, or with a minimal amount of, oxidation of the tin, the copper, and/or the tin-copper master alloy. Stated differently, the heating the mixture of tin and copper at 515 may be free from, or at least substantially free from, oxidizing the tin, copper, and/or tin-copper master alloy. In particular, the heating at 515 may be performed in air and/or in the presence of oxygen, and the master alloy set point temperature and/or the ratio of tin and copper within the mixture of tin and copper may be selected to prevent or avoid oxidation of the tin, copper, and/or tin-copper master alloy. Additionally or alternatively, the heating the mixture of tin and copper at 515 may be performed in an oxygen free, or an oxygen depleted, environment such as in a vacuum and/or under an inert gas such as $CO_2$, $N_2$, and/or Ar.

The heating the mixture of tin and copper at 515 further may include cooling the mixture of tin and copper and/or the tin-copper master alloy from the master alloy set point temperature to an ambient temperature. As discussed herein, ambient temperature may include room temperature and/or a temperature in the range of 10-35° C.

With continued reference to FIG. 8, methods 500 include forming a bismuth-tin-copper alloy at 520. The forming the bismuth-tin-copper alloy at 520 additionally or alternatively may be referred to as alloying bismuth with tin and copper to form the bismuth-tin-copper alloy at 520. The forming the bismuth-tin-copper alloy at 520 may include combining, intermixing, alloying, and/or reacting bismuth with tin, copper, and/or the tin-copper master alloy. In various embodiments, the forming the bismuth-tin-copper alloy may include forming any of the alloy phases or alloy domains discussed herein and/or any of the metallic bonds discussed herein. Additionally or alternatively, the forming the bismuth-tin-copper alloy may include dissolving at least a portion of tin, copper, and/or the tin-copper master alloy into bismuth and/or dissolving at least a portion of the bismuth into the tin-copper master alloy. As yet another embodiment, the forming the bismuth-tin-copper alloy may comprise forming a homogenous liquid mixture of the tin-copper master alloy and bismuth, and the forming further may include cooling the homogenous liquid mixture to form a homogenous solid mixture of bismuth, tin, and copper.

The forming the bismuth-tin-copper alloy at 520 may include forming any of the bismuth-tin-copper alloys discussed herein with reference to FIG. 1. More specifically, forming the bismuth-tin-copper alloy at 520 may include forming a bismuth-tin-copper alloy having any of the compositions and/or properties discussed herein.

The forming the bismuth-tin-copper alloy may be performed with any suitable sequence or timing within methods 500, such as subsequent to the forming the tin-copper master alloy at 505, prior to the heat treating the bismuth-tin-copper alloy at 535, and/or prior to the forming the bismuth-tin-copper alloy into a projectile shape at 555.

As shown in FIG. 8, the forming the bismuth-tin-copper alloy at 520 includes forming a mixture of bismuth and the tin-copper master alloy at 525. The forming the mixture of bismuth and the tin-copper master alloy at 525 may include any suitable process for adequately combining and mixing the bismuth and the tin-copper master alloy, such as discussed herein in connection with forming the mixture of tin and copper at 510. In particular, the forming the mixture of bismuth and the tin-copper master alloy may include combining any suitable phase or form of bismuth with any suitable phase or form of the tin-copper master alloy. In embodiments, the forming the mixture of bismuth and the tin-copper master alloy at 525 may include combining solids, such as powders and/or bulk pieces, of bismuth and the tin-copper master alloy. Additionally or alternatively, the forming the mixture of bismuth and the tin-copper master alloy at 525 may include utilizing liquid or molten bismuth and/or liquid or molten tin-copper master alloy to form the mixture of bismuth and the tin-copper master alloy. As a more specific embodiment, the forming the mixture of bismuth and the tin-copper master alloy at 525 may include adding a solid of, or a liquid of, the tin-copper master alloy to molten bismuth.

When the forming the mixture of bismuth and the tin-copper master alloy at 525 includes utilizing a liquid or molten phase of bismuth and/or the tin copper master alloy, the forming the mixture of bismuth and the tin-copper master alloy at 525 may include heating one or more of the bismuth and the tin-copper master alloy to or above the melting point of the respective metal or alloy to form the liquid or molten phase of the metal or alloy. In embodiments, the forming the mixture of bismuth and the tin-copper master alloy at 525 may include heating a quantity of bismuth to above its melting point and/or to at least 271.4° C. (520.5° F.) to melt the bismuth and adding the tin-copper master alloy to the molten bismuth. As another embodiment, when the forming the mixture of the bismuth and tin-copper master alloy at 525 comprises utilizing a molten or liquid tin-copper master alloy, the heating the tin-copper master alloy at 515 may include maintaining the tin-copper master alloy at the master alloy set point temperature until the tin-copper master alloy is added to bismuth during the forming the mixture at 525 and/or may not include cooling the tin-copper master alloy.

The forming the mixture of bismuth and the tin-copper master alloy at 525 further may include mechanically agitating bismuth and the tin-copper master alloy, such as discussed herein with reference to the forming at 510. The forming the mixture of bismuth and the tin-copper master alloy also may include combining bismuth and the tin-copper master alloy in any suitable ratio or proportion, such as to produce a mixture of bismuth, tin, and copper and/or a bismuth-tin-copper alloy that possesses a desired composition or weight percentage of bismuth, tin, and copper, such as any of the compositions discussed herein.

The forming the mixture of bismuth and the tin-copper master alloy may be performed with any suitable sequence or timing within methods 500, such as prior to, or substantially simultaneously with the heating the mixture of bismuth and the tin-copper master alloy at 530 and/or subsequent to the forming the tin-copper master alloy at 505.

With continued reference to FIG. 8, the forming the bismuth-tin-copper alloy further includes heating the mixture of bismuth and the tin-copper master alloy to a bismuth alloy set point temperature at 530. The heating the mixture of bismuth and the tin-copper alloy master may be performed in a temperature-controlled environment and/or a thermally controlled device, such as a thermally regulated furnace or oven. The heating the mixture of bismuth-tin-copper alloy at 530 may include melting at least one of, or both of, bismuth and the tin-copper master alloy and/or forming a homogenous liquid mixture of bismuth, tin, and copper. Additionally, or alternatively, the heating the mixture of bismuth and the tin-copper master alloy may include alloying bismuth with tin and copper, dissolving at least a portion of the tin-copper master alloy into the bismuth, dissolving at least a portion of the bismuth into the tin-copper master alloy, reacting the tin with the tin-copper master alloy, and/or forming one or more of Bi—Sn alloy domains, Bi—Cu alloy domains, and/or Bi—Sn—Cu alloy domains. With this in mind, the heating the mixture of bismuth and the tin-copper master alloy may include or be performed as a portion of the forming the mixture of bismuth and the tin-copper master alloy at 525, such as discussed herein for the heating the mixture of tin and copper at 515.

In view of the above, the bismuth alloy set point temperature may include a temperature that is sufficient to melt at least one of bismuth and the tin-copper master alloy, alloy bismuth with tin and copper, dissolve at least a portion of the tin-copper master alloy into the bismuth, dissolve at least a portion of the bismuth into the tin-copper master alloy, react the tin with the tin-copper master alloy, and/or form one or more of Bi—Sn alloy domains, Bi—Cu alloy domains, and/or Bi—Sn—Cu alloy domains. As more specific embodiments, the bismuth alloy set point temperature may include at least one of at least 272° C., at least 275° C., at least 280° C., at least 285° C., at least 290° C., at least 295° C., at least 300° C., at least 310° C., at least 320° C., at least 350° C., at most 300° C., at most 310° C., at most 320° C., at most 350° C., at most 375° C., and at most 400° C. As discussed herein, the bismuth alloy set point temperature may be or include a temperature range such as defined within any of the temperatures listed above.

The heating the mixture of bismuth and the tin-copper master alloy at 530 also may include maintaining the mixture of bismuth and the tin-copper master alloy at the bismuth alloy set point temperature for a bismuth alloying time. The bismuth alloying time may be or include an amount of time that the mixture of bismuth and the tin-copper master alloy needs to be maintained at the bismuth alloy set point temperature to adequately alloy bismuth with the tin-copper master alloy. In embodiments, the bismuth alloying time may include at least one of at least 5 minutes, at least 10 minutes, at least 15 minutes, at least 20 minutes, at least 30 minutes, at least 45 minutes, at least 60 minutes, at most 30 minutes, at most 45 minutes, at most 60 minutes, at most 120 minutes, and at most 240 minutes.

The heating the mixture of bismuth and the tin-copper master alloy may be performed without oxidizing bismuth, tin, and/or copper and/or may be performed such that at least a substantial portion of the bismuth, at least a substantial portion of the tin, and/or at least a substantial portion of the copper remain un-oxidized or in the metallic form following the heating at 530. Stated differently, the heating the mixture of bismuth and the tin-copper master alloy at 530 may be performed to minimize a propensity of bismuth, tin, and copper to oxidize. With this in mind, the heating the mixture of bismuth and the tin-copper master alloy at 530 may be performed in an oxygen-free or oxygen-depleted environment, such as under an inert gas or vacuum. Alternatively, the heating the mixture of bismuth and the tin-copper master alloy at 530 may be performed in air or in the presence of oxygen, such as at a concentration of approximately 20% of the heating atmosphere. In this case, the bismuth-alloy set point temperature may be selected to be lower than the temperature at which any of bismuth, tin, or copper readily oxidize in air or in the presence of oxygen and/or oxidize more quickly than the alloy can be formed. As a more specific embodiment, when the heating at 530 is performed in air or in the presence of oxygen, the bismuth alloy set point temperature may be at most 375° C. In such cases, the forming the tin-copper master alloy at 505 may include forming a tin-copper master alloy with a lower weight percentage of copper, such as at most 20 wt % copper, such that a lower bismuth-alloy set point temperature may be utilized to form the bismuth-tin-copper alloy.

The heating the mixture of bismuth and the tin-copper master alloy at 530 further may include cooling the mixture of bismuth and the tin-copper master alloy and/or the bismuth-tin-copper alloy from the bismuth alloy set point temperature to ambient temperature. Alternatively, the cooling may include cooling the mixture of bismuth and the tin-copper master alloy and/or the bismuth-tin-copper alloy from the bismuth alloy set point temperature to a heat-treatment temperature, such as discussed in more detail herein. The cooling may be performed subsequent to maintaining the mixture of bismuth and the tin-copper master alloy at the bismuth alloy set point temperature for the bismuth alloying time and/or subsequent to the mixture reaching the bismuth alloy set point temperature.

With continued reference to FIG. 8, methods 500 may include heat treating the bismuth-tin-copper alloy at 535. When included, the heat treating the bismuth-tin-copper alloy may be performed with any suitable sequence or timing within methods 500, such as, prior to the applying at 560, prior to the assembling at 565, and/or subsequent to the forming the bismuth-tin-copper alloy at 520. The heat treating at 535 additionally or alternatively may be performed prior to or intermittent with the forming the bismuth-tin-copper alloy into the firearm projectile shape at 555. More specifically, in some embodiments, the forming the bismuth-tin-copper alloy into a firearm projectile shape at 555 includes casting the bismuth-tin-copper alloy into a cast, followed by loading the cast into a die and compacting the cast into the firearm projectile shape. In some such embodiments, the heat treating is performed on the cast of bismuth-tin-copper alloy. In other words, in some such embodiments, the heat treating is performed subsequent to casting the bismuth-tin-copper alloy and prior to compacting the bismuth-tin-copper alloy into the die.

The heat treating at 535 may include annealing the bismuth-tin-copper alloy, stress relieving the bismuth-tin-copper alloy, increasing the malleability of the bismuth-tin-copper alloy, facilitating grain refinement within the bismuth-tin-copper alloy, and/or growing one or more alloy phases within the bismuth-tin-copper alloy. The heat treating the bismuth-tin-copper alloy may be performed within any suitable atmosphere and/or environment, such as in the presence of oxygen, or under an oxygen-depleted or oxygen-free atmosphere. The heat treating the bismuth-tin-copper alloy also may be performed in a temperature-controlled environment and/or device, such as a thermally regulated furnace or oven.

As shown in FIG. 8, the heat treating the bismuth-tin-copper alloy at 535 may include heating the bismuth-tin-copper alloy to a heat treatment set point temperature at 540. The heat treatment set point temperature may be adequate to facilitate any of the microstructural changes discussed herein within the bismuth-tin-copper alloy but may be less than a melting point of the bismuth-tin-copper alloy. In embodiments, the heat treatment set point temperature may include at least one of at least 100° C., at least 150° C., at least 175° C., at least 200° C., at least 220° C., at least 230° C., at least 240° C., at least 260° C., at least 280° C., at least 300° C., at most 260° C., at most 280° C., at most 300° C., at most 325° C., and at most 350° C. The heat treatment set point temperature may include a temperature range, such as a temperature range defined between any of the above-listed temperatures.

The heating the bismuth-tin-copper alloy to the heat treatment set point temperature at 540 may include heating the bismuth-tin-copper alloy from ambient temperature to the heat treatment set point temperature. Alternatively, when the heating the mixture of bismuth and the tin-copper master alloy at 530 does not include cooling the mixture of bismuth and the tin copper master alloy and/or cooling the bismuth-tin-copper alloy formed during the heating at 530, the heating the bismuth-tin-copper alloy at 540 may include cooling the bismuth-tin-copper alloy from the bismuth alloy set point temperature to the heat treatment set point temperature.

The heat treating the bismuth tin-copper alloy at 535 further may include maintaining the bismuth-tin-copper alloy at the heat treatment set point temperature for a heat treatment time at 545. The heat treatment time may be a duration of time that is adequate to heat treat, anneal, and/or stress relieve the bismuth-tin-copper alloy. In embodiments, the heat treatment time may include at least one of at least 30 minutes, at least 60 minutes, at least 120 minutes, at least 180 minutes, at least 240 minutes, at least 300 minutes, at least 360 minutes, at most 240 minutes, at most 300 minutes, at most 360 minutes, and at most 420 minutes.

With continued reference to FIG. 8, the heat treating the bismuth-tin-copper alloy further may include cooling the bismuth-tin-copper alloy from the heat treatment set point temperature to ambient temperature at a predetermined cool rate at 550. Stated differently, the cooling the bismuth-tin-copper alloy at 550 may include controlling the rate at which the bismuth-tin-copper alloy cools from the heat treatment set point temperature. In certain embodiments, the cooling the bismuth-tin-copper alloy at 550 may include regulating a cooling rate of the bismuth-tin-copper alloy such that the cooling rate is slower than would be achieved by permitting the bismuth-tin-copper alloy to passively equilibrate to the ambient temperature. As more specific embodiments, the predetermined cool rate may include a cool rate of at least one of at least 0.5° C. per minute (° C./min), at least 1° C./min, at least 1.2° C./min, at least 1.3° C./min, at least 1.5° C./min, at least 1.6° C./min, at least 1.7° C./min, at most 1.7° C./min, at most 1.8° C./min, at most 1.9° C./min, at most 2° C./min, at most 3° C./min, at most 4° C./min, at most 5° C./min, at most 7° C./min and at most 10° C./min.

As shown in FIG. 8, methods 500 may include forming the bismuth-tin-copper alloy into a firearm projectile shape at 555. In embodiments, the firearm projectile shape may include any of the firearm projectile shapes discussed herein, such as a bullet, a slug, and a shot pellet. The forming at 555 also may include forming a plurality of firearm projectile shapes from the bismuth-tin-copper alloy, which may be the same or different projectile shapes. The forming the bismuth-tin-copper alloy into the firearm projectile shape may utilize any suitable and/or conventional process for forming firearm projectile shapes from a metal, or a metal alloy, such as conventional processes that are utilized for forming lead into firearm projectile shapes. In embodiments, the forming the bismuth-tin-copper alloy into a firearm projectile shape at 555 may include casting, forging, swaging, and/or compacting the bismuth-tin-copper alloy. As a more specific embodiment, the forming the bismuth-tin-copper alloy into the firearm projectile shape at 555 may include pouring the bismuth-tin-copper alloy into a cast. In some embodiments, the cast may be, include, or define, the firearm projectile shape. Alternatively, the bismuth-tin-copper alloy may be cast into a mold to form a rod or ingot of the bismuth-tin-copper alloy, which may be further processed into the firearm projectile shape. As an embodiment, the forming the bismuth-tin-copper alloy into a firearm projectile shape may include loading a cast, rod, or ingot of the bismuth-tin-copper alloy into a die and applying a compaction force to the bismuth-tin-copper alloy that is adequate to form the bismuth-tin-copper alloy into a shape defined by the die. In particular, the die may define a near-net shape, and optionally a final shape, of the firearm projectile shape. In embodiments, the compaction force may include at least one of at least 500 pound force (lbf) at least 1000 lbf, at least 2000 lbf, at least 3000 lbf, at least 4000 lbf, at least 5000 lbf, at most 5000 lbf, at most 7500 lbf, and at most 10,000 lbf. The compacting the bismuth-tin-copper alloy may include deforming the bismuth-tin-copper alloy without substantially cracking or fatiguing the bismuth-tin-copper alloy. The forming the bismuth-tin-copper alloy into the firearm projectile shape also may be referred to as forming bismuth-tin-copper alloy into the projectile body and/or forming the bismuth-tin-copper alloy into the bismuth-based firearm projectile, such as discussed herein.

With continued reference to FIG. 8, methods 500 may include applying a coating to an exterior of the firearm projectile shape at 560. More specifically, the applying the coating at 560 may include applying a coating to the exterior of the firearm projectile shape or projectile body that is formed during the forming at 555. The coating may include any of the coatings discussed herein, such as an oxidation-resistant coating, a corrosion-inhibiting coating, a melt-resistant coating, a fouling-preventing coating, a jacket coating, a metallic coating, and/or a non-metallic coating. The applying the coating may be performed in any suitable manner, embodiments of which include spraying the exterior of the firearm projectile with the coating and/or dipping the firearm projectile in the coating. As more embodiments, when the coating is or includes a metallic coating, the coating the exterior of the firearm projectile may include applying the metallic coating utilizing an electroplating process.

In other embodiments, when the coating is a jacket coating, the applying the coating may include jacketing the firearm projectile, such as via a swaging process. When the coating is a jacket coating, the applying the coating at 560 may include chemically bonding the bismuth-tin-copper alloy and/or the projectile body to the jacket coating. More specifically, the chemically bonding the bismuth-tin-copper alloy and/or the projectile body to the jacket coating may include applying a brazing flux, such as a bismuth-tin brazing flux, to an interior of the jacket coating, placing the bismuth-tin-copper alloy and/or the projectile body in the jacket coating, and heating the jacket coating and the bismuth-tin-copper alloy and/or projectile body to chemically bond and/or braze the jacket coating with the bismuth-tin-copper alloy. Stated differently, when the coating is a jacket coating, the applying the coating at 560 may include brazing the jacket coating with the bismuth-tin-copper alloy and/or projectile body and/or may include core-bonding the jacket coating with the bismuth-tin-copper alloy and/or the projectile body.

When included, the applying the coating at 560 may be performed subsequent to the forming the bismuth-tin-copper alloy into the firearm projectile shape at 555 and/or prior to the assembling the firearm cartridge at 565.

As shown in FIG. 8, methods 500 may include assembling a firearm cartridge that includes at least one bismuth-based firearm projectile at 565. Assembling the firearm cartridge additionally or alternatively may be referred to herein as loading or forming the firearm cartridge. The assembling at 565 may include assembling any of the firearm cartridges that are discussed herein, such as the embodiments of firearm cartridges that are illustrated and discussed herein with reference to FIGS. 4 and 5. More specifically, the at least one bismuth-based firearm projectile is prepared by performing any suitable sequence or combination of preceding steps of methods 500, and the assembling at 565 may include loading the at least one bismuth-based firearm projectile into a casing that includes a propellant and a primer configured to ignite the propellant.

As shown in FIG. 9, methods 600 may have relatively fewer steps than methods 500, because the bismuth-nickel alloy 15 does not require forming a master alloy to be combined with bismuth. Otherwise, the steps of methods 600 may be the same or similar to some or all of the steps of methods 500 with nickel substituted for the tin-copper master alloy and/or bismuth-nickel alloy substituted for bismuth-tin-copper alloy, and similar numbers are used to identify similar steps. Despite any additions, omissions, or variations discussed below in the methods 600 as compared the methods 500, the methods 500 are still applicable as alternative or additional approaches in forming the bismuth-nickel alloy 15. As discussed further below, the ductility and malleability of the bismuth-nickel alloy 15 allow for additional approaches of forming the bismuth-nickel alloy into a projectile shape at 655 including extrusion of bismuth-based wire. Extrusion may be relatively more cost-effective and easier than other disclosed forming methods.

With continued reference to FIG. 9, methods 600 include forming a bismuth-nickel alloy at 620. The nickel discussed herein may be pure nickel or a nickel alloy, for example nickel-copper. The forming the bismuth-nickel alloy at 620 may include combining, intermixing, alloying, and/or reacting bismuth with nickel in the manners discussed above for forming the bismuth-tin-copper alloy at 520. The forming the bismuth-tin-nickel alloy at 620 may include forming a bismuth-nickel alloy having any of the compositions and/or properties discussed herein.

As shown in FIG. 9, the forming the bismuth-nickel alloy at 620 includes forming a mixture of bismuth and nickel at 625. The forming the mixture of bismuth and the nickel at 625 may include any suitable process for adequately combining and mixing the bismuth and the nickel, such as discussed herein in connection with forming the mixture of bismuth and the tin-copper master alloy at 525. In certain embodiments, the forming the mixture of bismuth and nickel at 625 may include adding solid nickel, such as a solid nickel ingot, to molten bismuth.

With continued reference to FIG. 9, the forming the bismuth-nickel alloy 620 further includes heating the mixture of bismuth and nickel to a bismuth alloy set point temperature at 630. The heating the mixture of bismuth and nickel may be performed in a melting crucible, temperature-controlled environment, and/or a thermally controlled device. The heating the mixture of bismuth-nickel alloy at 630 may include melting at least one of, or both of, bismuth and nickel and/or forming a homogenous liquid mixture of bismuth and nickel. Additionally, or alternatively, the heating the mixture of bismuth and nickel at 630 may include alloying or dissolving nickel into bismuth in manners similar to heating the mixture of bismuth and tin-copper alloy at 530, including forming one or more of Bi—Ni alloy domains and/or Bi—Ni metallic bonds.

In view of the above, the bismuth alloy set point temperature may include a temperature that is sufficient to perform any of the above heating methods. In embodiments, the bismuth alloy set point temperature may range from about 550° F. to 900° F. or from about 600° F. to 850° F. (315.6° C. to 454.4° C.). In further embodiments, the bismuth alloy set point temperature may range from about 600° F. to 700° F. This liquidus alloying temperature is relatively low to minimize the possibility of oxidation. As more embodiments, the bismuth alloy set point temperature may include at least one of at least 550° F., at least 575° F., at least 600° C., at least 625° F., at least 640° F., at least 650° F., at least 675° F., at least 700° F., at least 725° F., at least 750° F., at least 775° F., at least 800° F., at least 825° F., at least 850° F., at most 850° F., at most 800° F., at most 750° F., at most 700° F., and at most 650° F. As discussed herein, the bismuth alloy set point temperature may be or include a temperature range such as defined within any of the temperatures listed above.

The heating the mixture of bismuth and the tin-copper master alloy at 630 also may include maintaining the mixture of bismuth nickel at the bismuth alloy set point temperature for a bismuth alloying time. The bismuth alloying time may be or include an amount of time that the mixture of bismuth and nickel needs to be maintained at the bismuth alloy set point temperature to adequately alloy bismuth with nickel and/or to adequately dissolve nickel with bismuth. In embodiments, the bismuth alloying time may include at least one of at least 2 hours, at least 3 hours, at least 4 hours, at least 5 hours, at least hours, at least 7 hours, at least 8 hours, at least 9 hours, at least 10 hours, at most 11 hours, at most 10 hours, at most 9 hours, and at most 8 hours. The heating the mixture of bismuth and nickel at 630 further may include cooling the mixture of bismuth and nickel and/or the bismuth-nickel alloy, such as discussed with methods 500.

With continued reference to FIG. 9, methods 600 may include heat treating the bismuth-nickel alloy at 635 in manners similar as discussed above in reference to heat treating 535, and may include heating to a heating the bismuth-nickel alloy to a set point temperature 640 that may be maintained for a heat treatment time at 645. In embodiments, the heat treatment set point temperature may include at least one of at least 400° F., at least 410° F., at least 420° F., at least 430° F., at least 440° F., at least 450° F., at least 460° F., at least 470° F., at least 480° F., at least 490° F., at least 500° F., at most 450° F., at most 500° F., at most 550° F., and at most 600° F. The heat treatment set point temperature may include a temperature range, such as a temperature range defined between any of the above-listed temperatures, for example, between 450° F. and 480° F.

The heat treating the bismuth-nickel alloy at 635 further may include maintaining the bismuth-tin-copper alloy at the heat treatment set point temperature for a heat treatment time at 645. In embodiments, the heat treatment time may include at least one of at least 1 hour, at least 2 hours, at least 3 hours, at least 4 hours, at least 5 hours, at least 6 hours, at most 3 hours, at most 4 hours, at most 5 hours, and a range defined between any of the above-listed times, for example between 3.5 and 4.5 hours With continued reference to FIG. 9, the heat treating the bismuth-nickel alloy further may include cooling the bismuth-nickel alloy from the heat treatment set point temperature to ambient temperature at a predetermined cool rate at 650. In some embodiments, the cooling the bismuth-nickel alloy at 650 may include leaving the bismuth-nickel alloy (in the form of, for example, cast rods) in the oven or other heating treating device after it has been shut off after the heating cycle. As more specific embodiments, the predetermined cool rate may include a cool rate of at least one of at least 1° F. per minute, at least 2° F./min, at least 2.5° F./min, at least 3° F./min, at least 3.5° F./min, at least 4° F./min, at least 4.5° F./min, at least 5° f/min, at most 3° F./min, at most 3.5° F./min, at most 4° F./min, at most 4.5° F./min, at most 5° F./min, and a range defined between any of the above-listed rates, for example, between 3° F./min and 4° F./min.

As shown in FIG. 9, methods 600 may include forming the bismuth-nickel alloy into a firearm projectile shape at 655. The forming the bismuth-nickel alloy into the firearm projectile shape at 655 may utilize processes and the embodiments discussed above with reference to the bismuth-tin-copper alloy 14 in FIG. 8. As such, the above descriptions of step 555 may apply to step 655 in method 600. Similarly, methods 600 may include applying a coating to an exterior of the firearm projectile shape at 660 and/or assembling a firearm cartridge that includes at least one bismuth-based firearm projectile at 665, which steps are substantially similar to steps 560 and 565 in methods 500. The descriptions of steps 560 and 565 above apply to steps 660 and 665 in methods 600.

The forming into a firearm projectile shape at 655 may include any of the embodiments described above with regard to methods 500 and forming into firearm projectile shape at 555. In certain embodiments, the forming the bismuth-nickel alloy into a projectile shape at 655 may include extruding a wire of the bismuth-nickel alloy, the wire having a diameter the same or similar to an intended projectile diameter. The extruded wire of bismuth-nickel alloy may be cut or otherwise divided into individual projectiles.

In some embodiments, the forming into a firearm projectile shape at 655 may include sizing to bring the formed projectile core of the bismuth-nickel alloy to a predetermined weight. The predetermined weight may correspond to an intended projectile caliber. The sizing may be performed during any of the disclosed methods of forming. In an embodiment, the forming into a firearm projectile shape at 655 may be performed in a die (for example, while swaging), the die having bleed holes that allow excess alloy material to flow out until the bismuth-nickel alloy achieves the desired weight. The excess alloy material may then be melted back in with the cast alloy and applied in the methods 600 for forming additional projectiles.

With continued reference to FIG. 9, methods 600 may include applying a coating to an exterior of the firearm projectile shape at 660, which may be similar to the applying a coating in the methods 500 at 550. In some embodiments, the methods 600 may include gilding or coating with a jacket. More specifically, the applying the coating to an exterior at 660 may include applying a jacket coating of copper.

As shown in FIG. 9, methods 600 may include assembling a firearm cartridge that includes at least one bismuth-based firearm projectile at 665, which may be in any similar manner as disclosed for assembling a firearm cartridge that includes at least one bismuth-based firearm projectile at 565 with methods 500.

The above-mentioned methods 600 for forming the bismuth-nickel alloy 15 were tested at various ratios of bismuth and nickel. In one embodiment, 99.84% bismuth and 0.16% nickel were found to provide some malleability in the final product, but less than that of the bismuth-tin-copper alloy 14. As a second embodiment, 99.75% bismuth and 0.25% nickel provided malleability similar to the bismuth-tin-copper alloy 14, and all nickel dissolved at a temperature of 640 F. As a third embodiment, 99.5% bismuth and 0.5% nickel was even more malleable and had a density of 9.76 g/cc with all nickel dissolving at a temperature of 700 F. Testing of the bismuth-nickel alloy 15 has shown greater ductility than the bismuth-tin-copper alloy 14, and greater malleability after subsequent annealing. In tests of the third embodiment above with 0.5% nickel when die cast and swaged with excess material bleeding out, the excess bleed material forms long extrusion strings as opposed to crumbling as observed in other embodiments. The strings of the bismuth-nickel alloy 15 in the third embodiment could be bent to greater than 90°, which is not possible with the bismuth-tin-copper alloy 14.

Example 1: A sample of the bismuth-nickel alloy was produced with 99.84% bismuth and 0.16% nickel. The sample demonstrated improved malleability, but was still relatively fragile and did not readily bend.

Example 2: A sample of the bismuth-nickel alloy was produced with 99.75% bismuth and 0.25% nickel. All of the nickel dissolved at about 640° F. The sample was more malleable than Example 1. The sample was still somewhat fragile, but had malleability similar to Bi/Sn/Cu alloy.

Example 3: A sample of the bismuth-nickel alloy was produced with 99.5% bismuth and 0.5% nickel. All of the nickel dissolved when the melt temperature was increased to 700° F. When forming the resulting sample, the bleed material formed long strings rather than crumbling and falling apart, exhibiting increased ductility and malleability over Examples 1 and 2. The bleed strings were annealed and were still malleable and could be bent without breaking. The density of the sample in Example 3 was calculated to be 9.76 g/cc.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or"

clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, an object that is at least substantially formed from a material includes an object for which at least 75% of the object is formed from the material and also includes an object that is completely formed from the material. As another example, a first direction that is at least substantially parallel to a second direction includes a first direction that forms an angle with respect to the second direction that is at most 22.5 degrees and also includes a first direction that is exactly parallel to the second direction. As another example, a first length that is substantially equal to a second length includes a first length that is at least 75% of the second length, a first length that is equal to the second length, and a first length that exceeds the second length such that the second length is at least 75% of the first length.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

Examples of bismuth-based firearm projectiles, methods for forming the same, and firearm cartridges including the same are presented in the following enumerated paragraphs.

A1. A bismuth-based firearm projectile, comprising:

a projectile body comprising a bismuth-tin-copper alloy that forms at least 90 weight percent (wt %) of the projectile body;

wherein the bismuth-tin-copper alloy comprises an alloy of bismuth, tin, and copper; and wherein the bismuth-tin-copper alloy comprises at least 85 wt % bismuth.

A2. The firearm projectile of paragraph A1, wherein the bismuth-tin-copper alloy comprises at least one of at least 0.01 wt % copper, at least 0.05 wt % copper, at least 0.1 wt % copper, at least 0.12 wt % copper, at least 0.15 wt % copper, at least 0.2 wt % copper, at least 0.25 wt % copper, at least 0.3 wt % copper, at least 0.5 wt % copper, at least 0.75 wt % copper, and at most 0.2 wt % copper, at most 0.25 wt % copper, at most 0.3 wt % copper, at most 0.5 wt % copper, at most 0.75 wt % copper, at most 1 wt % copper, at most 1.5 wt % copper, at most 2 wt % copper, at most 3 wt % copper, and at most 5 wt % copper.

A2.1. The firearm projectile of any of paragraphs A1-A2, wherein the bismuth-tin-copper alloy comprises at least one of at least 0.5 wt % tin, at least 0.7 wt % tin, at least 0.8 wt % tin, at least 0.9 wt % tin, at least 1 wt % tin, at least 1.25 wt % tin, at least 1.5 wt % tin, at least 1.75 wt % tin, at least 1.8 wt % tin, at least 2 wt % tin, at least 3 wt % tin, at least 5 wt % tin, at most 1.8 wt % tin, at most 2 wt % tin, at most 2.5 wt % tin, at most 3 wt % tin, at most 5 wt % tin, at most 6 wt % tin, at most 7 wt % tin, at most 8 wt % tin, at most 9 wt % tin, at most 9.5 wt % tin, at most 9.8 wt % tin, at most 10 wt % tin, and at most 15 wt % tin.

A2.2. The firearm projectile of any of paragraphs A1-A2.1, wherein the bismuth-tin-copper alloy comprises at least one of at least 88 wt % bismuth, at least 90 wt % bismuth, at least 91 wt % bismuth, at least 92 wt % bismuth, at least 93 wt % bismuth, at least 94 wt % bismuth, at least 95 wt % bismuth, at least 96 wt % bismuth, at least 97 wt % bismuth, at least 98 wt % bismuth, at least 99 wt % bismuth, at most 97 wt % bismuth, at most 98 wt % bismuth, at most 98.5 wt % bismuth, and at most 99 wt % bismuth.

A2.3. The firearm projectile of any of paragraphs A1-A2.2, wherein the bismuth-tin-copper alloy comprises 90-99 wt % bismuth, 0.7-9.5 wt % tin, and 0.05-3 wt % copper.

A2.3.1. The firearm projectile of paragraph A2.3, wherein the bismuth-tin-copper alloy comprises 97-99 wt % bismuth, 0.3-2.9 wt % tin, and 0.05-0.9 wt % copper.

A2.3.2. The firearm projectile of paragraph A2.3.1, wherein the bismuth-tin-copper alloy comprises 97.5-98.5 wt % bismuth, 1-2.4 wt % tin, and 0.075-0.75 wt % copper.

A3. The firearm projectile of any of paragraphs A1-A2.3.2, wherein the copper is exchanged for a third metal that is different from copper.

A3.1. The firearm projectile of paragraph A3, wherein the third metal is one of antimony and zinc.

A3.2. The firearm projectile of any of paragraphs A1-A3.1, wherein the bismuth-tin-copper alloy further comprises a fourth metal, wherein the fourth metal is one of antimony and zinc.

A3.3. The firearm projectile of any of paragraphs A1-A3.2, wherein the bismuth-tin-copper alloy forms at least one of at least 92 wt %, at least 94 wt %, at least 96 wt %, at least 98 wt %, at least 99 wt %, and at most 100 wt % of the projectile body.

A4. The firearm projectile of any of paragraphs A1-A3.3, further comprising a coating applied to an exterior of the projectile body.

A4.1. The firearm projectile of paragraph A4, wherein the coating is or includes a metallic coating.

A4.1.1. The firearm projectile of paragraph A4.1, wherein the metallic coating includes one or more of copper, a copper alloy, nickel, a nickel alloy, iron, an iron alloy, zinc, aluminum, tungsten, and gilding metal.

A4.1.2. The firearm projectile of any of paragraphs A4.1-A4.1.1, wherein the metallic coating is applied to the exterior of the projectile body by an electroplating process.

A4.2. The firearm projectile of any of paragraphs A4-A4.1.2, wherein the coating is or includes a jacket.

A4.3. The firearm projectile of any of paragraphs A4-A4.2, wherein the coating is or includes a non-metallic coating, wherein the non-metallic coating includes one or more of a plastic coating, a nylon coating, a polymer coating, and a resin coating.

A4.4. The firearm projectile of any of paragraphs A4-A4.3, wherein the coating is configured to reduce a propensity for the exterior of the projectile body to melt during firing of the bismuth-based firearm projectile from a firearm.

A5. The firearm projectile of any of paragraphs A1-A4.4, wherein the projectile body comprises a stiffness that is less than a stiffness of a bismuth-tin projectile body of an equivalent size and shape, wherein the bismuth-tin projectile body consists of a bismuth-tin alloy.

A5.1. The firearm projectile of paragraph A5, wherein the stiffness of the projectile body is a threshold fraction of the stiffness of the bismuth-tin projectile body, and wherein the threshold fraction is at least one of at least 60%, at least 70%, at most 70%, at most 80%, at most 85%, at most 90%, and at most 90%.

A5.2. The firearm projectile of any of paragraphs A5-A5.1, wherein the bismuth-tin alloy comprises 95 wt % bismuth and 5 wt % tin.

A6. The firearm projectile of any of paragraphs A1-A5.2, wherein the projectile body comprises a density of at least one of at least 9.4 grams per cubic centimeter (g/cc), at least 9.5 g/cc, at least 9.55 g/cc, at least 9.6 g/cc, at least 9.65 g/cc, at least 9.7 g/cc, at least 9.71 g/cc, at least 9.72 g/cc, at least 9.73 g/cc, at least 9.74 g/cc, at least 9.75 g/cc, at most 9.72 g/cc, at most 9.73 g/cc, at most 9.74 g/cc, at most 9.75 g/cc, at most 9.76 g/cc, and at most 9.78 g/cc.

A7. The firearm projectile of any of paragraphs A1-A6, wherein the copper is at least substantially dissolved in one or more of the tin and the bismuth.

A7.1. The firearm projectile of any of paragraphs A1-A7, wherein the bismuth-tin-copper alloy comprises one or more alloy domains, and wherein the one or more alloy domains comprise one or more of Sn—Cu alloy domains, Bi—Cu alloy domains, Sn—Bi alloy domains, and Bi—Sn—Cu alloy domains.

A7.2. The firearm projectile of any of paragraphs A1-A7.1, wherein the copper facilitates grain refinement within the bismuth-tin-copper alloy.

A7.3. The firearm projectile of any of paragraphs A1-A7.2, wherein the bismuth-tin-copper alloy is one or more of an annealed alloy, a stress-relieved alloy, and a heat-treated alloy.

A8. The firearm projectile of any of paragraphs A1-A7.3, wherein the bismuth-based firearm projectile is a frangible firearm projectile, wherein the frangible firearm projectile has a weight and is configured to break entirely into small particulate when fired at a metal surface at close range from a firearm cartridge, and wherein the small particulate has a maximum particle weight of 5% of the weight of the frangible firearm projectile.

A9. The firearm projectile of any of paragraphs A1-A8, wherein the bismuth-based firearm projectile is at least one of a bullet, a slug, and a shot pellet.

A10. The firearm projectile of any of paragraphs A1-A9, wherein the bismuth-based firearm projectile is configured to be received within a firearm cartridge.

B1. A firearm cartridge, comprising:

a casing that defines an internal volume;

a propellant disposed in the internal volume;

a primer disposed in the internal volume and configured to ignite the propellant;

the bismuth-based firearm projectile of any of paragraphs A1-A10 at least partially received in the casing.

B2. The firearm cartridge of paragraph B1, wherein at least one of:

the bismuth-based firearm projectile is a bullet, and the firearm cartridge is a bullet cartridge;

the bismuth-based firearm projectile is a shot pellet, and the firearm cartridge is a shot shell;

the bismuth-based firearm projectile is a shot pellet, and the firearm cartridge is a shot shell containing a plurality of the bismuth-based firearm projectiles; and the bismuth-based firearm projectile is a shot slug and the firearm cartridge is a shot slug shell.

C1. A method of forming a bismuth-based firearm projectile, the method comprising:

forming a tin-copper master alloy, comprising:

forming a mixture of tin and copper;

heating the mixture of tin and copper to a master alloy set point temperature;

forming a bismuth-tin-copper alloy, comprising:

forming a mixture of bismuth and the tin-copper master alloy; and heating the mixture of bismuth and the tin-copper master alloy to a bismuth alloy set point temperature.

C2. The method of paragraph C1, further comprising forming the bismuth-tin-copper alloy into a firearm projectile shape.

C2.1. The method of paragraph C2, wherein the firearm projectile shape is at least one of a bullet, a slug, and a shot pellet.

C2.2. The method of any of paragraphs C2-C2.1, wherein the forming the bismuth-tin-copper alloy into the firearm projectile shape comprises casting the bismuth-tin-copper alloy into a mold to form a cast.

C2.3. The method of any of paragraphs C2-C2.2, wherein the forming the bismuth-tin-copper alloy into the firearm shape comprises loading the bismuth-tin-copper alloy into a die and applying a compaction force to the bismuth-tin-copper alloy.

C2.3.1. The method of paragraph C2.3, wherein the die defines a near-net shape, and optionally a final shape, of the firearm projectile shape.

C2.4. The method of any of paragraphs C2.3-C2.3.1, wherein the compaction force includes at least one of at least 500 pounds force (lbf), at least 1000 lbf, at least 2000 lbf, at least 3000 lbf, at least 4000 lbf, at least 5000 lbf, at most 5000 lbf, at most 7500 lbf, and at most 10,000 lbf.

C3. The method of any of paragraphs C1-C2.1, wherein the heating the mixture of the tin and the copper comprises melting at least the tin.

C3.1. The method of any of paragraphs C1-C3, wherein the forming the tin-copper master alloy comprises dissolving the copper in the tin.

C3.2. The method of any of paragraphs C1-C3.1, wherein the forming the tin-copper master alloy comprises forming a homogenous liquid mixture of tin and copper.

C3.3. The method of any of paragraphs C1-C3.2, wherein the master alloy set point temperature is at least one of at least 300° C., at least 350° C., at least 400° C., at least 450° C., at least 475° C., at least 500° C., at least 510° C., at least 520° C., at least 550° C., at most 500° C., at most 510° C., at most 520° C., at most 550° C., at most 575° C., at most 600° C., at most 700° C., at most 800° C., and at most 900° C.

C3.4. The method of any of paragraphs C1-C3.3, wherein the heating the mixture of tin and copper further comprises maintaining the mixture of tin and copper at the master alloy set point temperature for a master alloying time.

C3.5. The method of paragraph C3.4, wherein the master alloying time is at least one of at least 30 minutes, at least 60 minutes, at least 120 minutes, at least 180 minutes, at least 240 minutes, at least 300 minutes, at least 360 minutes, at most 120 minutes, at most 180 minutes, at most 240 minutes, at most 300 minutes, at most 360 minutes, and at most 480 minutes.

C3.6. The method of any of paragraphs C1-C3.5, wherein the heating the mixture of tin and copper is performed in the presence of oxygen.

C4. The method of any of paragraphs C1-C3.6, wherein the tin-copper master alloy comprises at least one of at least 5 wt % copper, at least 6 wt % copper, at least 7 wt % copper, at least 9 wt % copper, at least 10 wt % copper, at least 15 wt % copper, at least 20 wt % copper, at most 10 wt % copper, at most 15 wt % copper, at most 20 wt % copper, and at most 30 wt % copper.

C4.1. The method of any of paragraphs C1-C4, wherein the tin-copper master alloy comprises at least one of at least 70 wt % tin, at least 80 wt % tin, at least 85 wt % tin, at least 90 wt % tin, at least 91 wt % tin, at least 93 wt % tin, at least 94 wt % tin, at most 80 wt % tin, at most 85 wt % tin, at most 90 wt % tin, at most 91 wt % tin, at most 93 wt % tin, at most 94 wt % tin, and at most 95 wt % tin.

C4.2. The method of any of paragraphs C1-C4.1, wherein the tin-copper master alloy comprises 70-95 wt % tin and 5-30 wt % copper.

C5. The method of any of paragraphs C1-C4.2, wherein the forming the tin-copper master alloy further comprises cooling the mixture of tin and copper from the master alloy set point temperature to an ambient temperature.

C6. The method of any of paragraphs C1-05, wherein the heating the mixture of the bismuth and the copper-tin master alloy comprises melting at least one of the bismuth and the copper-tin master alloy.

C6.1. The method of any of paragraphs C1-C6, wherein the forming the bismuth-tin-copper alloy comprises forming a homogenous liquid mixture of bismuth, tin, and copper.

C6.2. The method of any of paragraphs C1-C6.1, wherein the forming the bismuth-tin-copper alloy comprises dissolving the tin-copper master alloy in the bismuth.

C6.3. The method of any of paragraphs C1-C6.2, wherein the bismuth alloy set point temperature is at least one of at least 272° C., at least 275° C., at least 280° C., at least 285° C., at least 290° C., at least 295° C., at least 300° C., at least 310° C., at least 320° C., at least 350° C., at most 300° C., at most 310° C., at most 320° C., at most 350° C., at most 375° C., and at most 400° C.

C6.4. The method of any of paragraphs C1-C6.3, wherein the heating the mixture of the bismuth and the tin-copper master alloy is performed in the presence of oxygen.

C6.4.1. The method of paragraph C6.4, wherein the bismuth alloy set point temperature is at most 375° C.

C6.5. The method of any of paragraphs C1-C6.4.1, wherein the heating the mixture of the bismuth and the tin-copper master alloy comprises maintaining the mixture of bismuth and the tin-copper master alloy at the bismuth alloy set point temperature for a bismuth alloying time.

C6.6. The method of paragraph C6.5, wherein the bismuth alloying time is at least one of at least 5 minutes, at least 10 minutes, at least 15 minutes, at least 20 minutes, at least 30 minutes, at least 45 minutes, at least 60 minutes, at most 30 minutes, at most 45 minutes, at most 60 minutes, at most 120 minutes, and at most 240 minutes.

C7. The method of any of paragraphs C1-C6.6, wherein the forming the bismuth-tin-copper alloy further comprises cooling the mixture of the bismuth and the tin-copper master alloy from the bismuth alloy set point temperature to an/the ambient temperature.

C8. The method of any of paragraphs C1-C7, wherein the bismuth-tin-copper alloy is the bismuth-tin-copper alloy of any of paragraphs A1-A10.

C9. The method of any of paragraphs C1-C8, further comprising heat treating the bismuth-tin-copper alloy, wherein the heat-treating comprises:

heating the bismuth-tin-copper alloy to a heat treatment set point temperature and maintaining the bismuth-tin-copper alloy at the heat treatment set point temperature for a heat treatment time.

C9.1. The method of paragraph C9, wherein the heat treating further comprises cooling the bismuth-tin-copper alloy from the heat treatment set point temperature to an/the ambient temperature at a predetermined cool rate.

C9.1.1. The method of paragraph C9.1, wherein the predetermined cool rate includes at least one of at least 0.5° C. per minute (° C./min), at least 1° C./min, at least 1.2° C./min, at least 1.3° C./min, at least 1.5° C./min, at least 1.6° C./min, at least 1.7° C./min, at most 1.7° C./min, at most 1.8° C./min, at most 1.9° C./min, at most 2° C./min, at most 3° C./min, at most 4° C./min, at most 5° C./min, at most 7° C./min, and at most 10° C./min.

C9.2. The method of any of paragraphs C9.1-C9.1.1, wherein the cooling the bismuth-tin-copper alloy from the heat treatment set point temperature includes regulating a cooling rate of the bismuth-tin-copper alloy such that the cooling rate is slower than would be achieved by permitting the bismuth-tin-copper alloy to passively equilibrate to the ambient temperature.

C10. The method of any of paragraphs C9-C9.2, wherein the heat treatment set point temperature is at least one of at least 100° C., at least 150° C., at least 175° C., at least 200° C., at least 220° C., at least 230° C., at least 240° C., at least 260° C., at least 280° C., at least 300° C., at most 260° C., at most 280° C., at most 300° C., at most 325° C., and at most 350° C.

C10.1. The method of any of paragraphs C9-C10, wherein the heat treatment time is at least one of at least 30 minutes, at least 60 minutes, at least 120 minutes, at least 180 minutes, at least 240 minutes, at least 300 minutes, at least 360 minutes, at most 240 minutes, at most 300 minutes, at most 360 minutes, and at most 420 minutes.

C11. The method of any of paragraphs C9-C10.1, wherein the heat treating comprises annealing the bismuth-tin-copper alloy.

C11.1. The method of any of paragraphs C9-C11, wherein the heat treating comprises stress relieving the bismuth-tin-copper alloy.

C12. The method of any of paragraphs C1-C11.1, further comprising applying a coating to an exterior of the bismuth-based firearm projectile.

C12.1. The method of paragraph C12, wherein the applying the coating comprises jacketing the bismuth-based firearm projectile.

C12.2. The method of paragraph C12, wherein the applying the coating comprises electroplating the coating onto the exterior of the bismuth-based firearm projectile.

C12.3. The method of any of paragraphs C12-C12.2, wherein the coating includes the coating of any of paragraphs A4-A4.4.

C13. A method of assembling a firearm cartridge, the method comprising:

forming at least one bismuth-based firearm projectile by the method of any of paragraphs C1-C12.3, and loading the at least one bismuth-based firearm projectile into a casing that includes a propellant and a primer configured to ignite the propellant.

C14. A method of assembling a firearm cartridge, the method comprising:

forming at least one bismuth-based firearm projectile of any of paragraphs A1-A10 by the methods of any of paragraphs C1-C12.3; and loading the at least one firearm projectile into a casing that includes a propellant and a primer configured to ignite the propellant.

C15. The use of the methods of any of paragraphs C1-C14 to form the bismuth-based firearm projectile of any of paragraphs A1-A10.

C16. The use of the alloys of any of paragraphs C1-C11.1 to form a firearm projectile, and optionally the bismuth-based firearm projectile of any of paragraphs A1-A10.

D1. A bismuth-based firearm projectile, comprising:

a projectile body comprising a bismuth-nickel alloy that forms at least 90 weight percent (wt %) of the projectile body;

wherein the bismuth-nickel alloy comprises an alloy of bismuth and nickel; and wherein the bismuth-nickel alloy comprises 90-99.9 wt % bismuth and 0.1-10 wt % nickel.

D2. The firearm projectile of paragraph D1, wherein the bismuth-nickel alloy comprises at least one of at least 0.12 wt % nickel, at least 0.14 wt % nickel, at least 0.16 wt % nickel, at least 0.18 wt % nickel, at least 0.2 wt % nickel, at least 0.25 wt % nickel, at least 0.3 wt % nickel, at least 0.5 wt % nickel, at least 0.75 wt % nickel, at most 0.2 wt % nickel, at most 0.25 wt % nickel, at most 0.3 wt % nickel, at most 0.5 wt % nickel, at most 0.75 wt % nickel, at most 1 wt % nickel, at most 1.5 wt % nickel, at most 2 wt % nickel, at most 3 wt % nickel, and at most 5 wt % nickel.

D3. The firearm projectile of any of paragraphs D1-D2, wherein the bismuth-nickel alloy comprises 99-99.9 wt % bismuth and 0.1-1 wt % nickel.

D4. The firearm projectile of paragraph D3, wherein the bismuth-nickel alloy comprises 99.2-99.9 wt % bismuth and 0.1-0.8 wt % nickel D5. The firearm projectile of any of paragraphs D1-D4, wherein the bismuth-nickel alloy forms at least one of at least 92 wt %, at least 94 wt %, at least 96 wt %, at least 98 wt %, at least 99 wt %, and at most 100 wt % of the projectile body.

D6. The firearm projectile of any of paragraphs D1-D5, further comprising a coating applied to an exterior of the projectile body.

D7. The firearm projectile of any of paragraphs D1-D6, wherein the coating is a copper jacket.

D8 The firearm projectile of any of paragraphs D1-D7, wherein the coating includes one or more of copper, a copper alloy, nickel, a nickel alloy, iron, an iron alloy, zinc, aluminum, tungsten, and gilding metal.

D9. The firearm projectile of any of paragraphs D1-D8, wherein the projectile body comprises a stiffness that is at most 50% of a stiffness of a bismuth-tin projectile body of an equivalent size and shape, wherein the bismuth-tin projectile body consists of a 95Bi5Sn alloy bismuth-tin alloy.

D10. The firearm projectile of paragraph D9, wherein the stiffness of the projectile body is a threshold fraction of the stiffness of the bismuth-tin projectile body, and wherein the threshold fraction is at least one of at least 40%, at least 50%, at least 60%, at least 70%, at most 70%, at most 80%, and at most 90%.

D11. The firearm projectile of any of paragraphs D1-D10, wherein the projectile body comprises a density of at least one of at least 9.4 grams per cubic centimeter (g/cc), at least 9.5 g/cc, at least 9.55 g/cc, at least 9.6 g/cc, at least 9.65 g/cc, at least 9.7 g/cc, at least 9.71 g/cc, at least 9.72 g/cc, at least 9.73 g/cc, at least 9.74 g/cc, at least 9.75 g/cc, at most 9.72 g/cc, at most 9.73 g/cc, at most 9.74 g/cc, at most 9.75 g/cc, at most 9.76 g/cc, and at most 9.78 g/cc.

D12. The firearm projectile of any of paragraphs D1-D11, wherein the nickel is at least substantially dissolved in the bismuth.

D13. The firearm projectile of any of paragraphs D1-D12, wherein the bismuth-nickel alloy comprises one or more Bi—Ni alloy domains.

D14. The firearm projectile of any of paragraphs D1-D13, wherein the bismuth-nickel alloy is one or more of an annealed alloy, a stress-relieved alloy, and a heat-treated alloy.

D15. The firearm projectile of any of paragraphs D1-D14, wherein the bismuth-based firearm projectile is a frangible firearm projectile, wherein the frangible firearm projectile has a weight and is configured to break entirely into small particulate when fired at a metal surface at close range from a firearm cartridge, and wherein the small particulate has a maximum particle weight of 5% of the weight of the frangible firearm projectile.

D16. A firearm cartridge, comprising:

a casing that defines an internal volume;

a propellant disposed in the internal volume;

a primer disposed in the internal volume and configured to ignite the propellant;

the bismuth-based firearm projectile of paragraph D1 at least partially received in the casing.

What is claimed is:

1. A bismuth-based firearm projectile, comprising:

a projectile body comprising a bismuth-nickel alloy that forms at least 90 weight percent (wt %) of the projectile body;

wherein the bismuth-nickel alloy comprises an alloy of bismuth and nickel; and wherein the bismuth-nickel alloy comprises 95-99.9 wt % bismuth and 0.1-5 wt % nickel; and wherein the bismuth-nickel alloy does not comprise copper or silver.

2. The firearm projectile of claim 1, wherein the bismuth-nickel alloy comprises at least one of at least 0.5 wt % nickel, at least 0.75 wt % nickel, at most 0.5 wt % nickel, at most 0.75 wt % nickel, at most 1 wt % nickel, at most 1.5 wt % nickel, at most 2 wt % nickel, at most 3 wt % nickel, and at most 5 wt % nickel.

3. The firearm projectile of claim 1, wherein the bismuth-nickel alloy comprises 99-99.9 wt % bismuth and 0.1-1 wt % nickel.

4. The firearm projectile of claim 1, wherein the bismuth-nickel alloy comprises 99.2-99.9 wt % bismuth and 0.1-0.8 wt % nickel.

5. The firearm projectile of claim 1, wherein the bismuth-nickel alloy forms at least one of at least 92 wt %, at least 94 wt %, at least 96 wt %, at least 98 wt %, at least 99 wt %, and at most 100 wt % of the projectile body.

6. The firearm projectile of claim 1, further comprising a coating applied to an exterior of the projectile body.

7. The firearm projectile of claim 6, wherein the coating is a copper jacket.

8. The firearm projectile of claim 6, wherein the coating includes one or more of copper, a copper alloy, nickel, a nickel alloy, iron, an iron alloy, zinc, aluminum, tungsten, and gilding metal.

9. The firearm projectile of claim 1, wherein the projectile body comprises a stiffness that is at most 50% of a stiffness of a bismuth-tin projectile body of an equivalent size and shape, wherein the bismuth-tin projectile body consists of a 95Bi5Sn alloy bismuth-tin alloy.

10. The firearm projectile of claim 9, wherein the stiffness of the projectile body is a threshold fraction of the stiffness of the bismuth-tin projectile body, and wherein the threshold fraction is at least one of at least 40%, at least 50%, at least 60%, at least 70%, at most 70%, at most 80%, and at most 90%.

11. The firearm projectile of claim 1, wherein the projectile body comprises a density of at least one of at least 9.4 grams per cubic centimeter (g/cc), at least 9.5 g/cc, at least 9.55 g/cc, at least 9.6 g/cc, at least 9.65 g/cc, at least 9.7 g/cc, at least 9.71 g/cc, at least 9.72 g/cc, at least 9.73 g/cc, at least 9.74 g/cc, at least 9.75 g/cc, at most 9.72 g/cc, at most 9.73 g/cc, at most 9.74 g/cc, at most 9.75 g/cc, at most 9.76 g/cc, and at most 9.78 g/cc.

12. The firearm projectile of claim 1, wherein the nickel is at least substantially dissolved in the bismuth.

13. The firearm projectile of claim 1, wherein the bismuth-nickel alloy comprises one or more Bi—Ni alloy domains.

14. The firearm projectile of claim 1, wherein the bismuth-nickel alloy is one or more of an annealed alloy, a stress-relieved alloy, and a heat-treated alloy.

15. The firearm projectile of claim 1, wherein the bismuth-based firearm projectile is a frangible firearm projectile, wherein the frangible firearm projectile has a weight and is configured to break entirely into small particulate when fired at a metal surface at close range from a firearm cartridge, and wherein the small particulate has a maximum particle weight of 5% of the weight of the frangible firearm projectile.

16. A firearm cartridge, comprising:

a casing that defines an internal volume;

a propellant disposed in the internal volume;

a primer disposed in the internal volume and configured to ignite the propellant;

the bismuth-based firearm projectile of claim 1 at least partially received in the casing.

17. A method for forming the bismuth-based firearm projectile of claim 1, the method comprising:

preparing the bismuth-nickel alloy;

extruding the bismuth-nickel alloy into a wire;

forming the wire into the projectile body of the bismuth-based firearm projectile of claim 1.

18. The method of claim 17, comprising:

after the extruding step, dividing the wire of the bismuth-nickel alloy; and forming a plurality of projectiles from the divided wire.

19. A bismuth-based firearm projectile, comprising:

a projectile body comprising a bismuth-nickel alloy that forms at least 90 weight percent (wt %) of the projectile body;

wherein the bismuth-nickel alloy consists essentially of an alloy of bismuth and nickel;

wherein the bismuth-nickel alloy comprises 95-99.9 wt % bismuth and 0.1-5 wt % nickel; and wherein the bismuth-nickel alloy does not comprise copper or silver.

20. A method for forming the bismuth-based firearm projectile of claim 19, the method comprising:

preparing the bismuth-nickel alloy;

extruding the bismuth-nickel alloy into a wire;

forming the wire into the projectile body of the bismuth-based firearm projectile of claim 19.

* * * * *